US006389770B1

(12) United States Patent
Santavicca

(10) Patent No.: US 6,389,770 B1
(45) Date of Patent: May 21, 2002

(54) CONTAINMENT FRAMING SYSTEM

(75) Inventor: Pietro N. Santavicca, Bala Cynwyd, PA (US)

(73) Assignee: Rough Brothers, Inc., Cincinnati, OH (US)

( * ) Notice: Subject to any disclaimer, the term of this patent is extended or adjusted under 35 U.S.C. 154(b) by 0 days.

(21) Appl. No.: 09/553,008

(22) Filed: Apr. 20, 2000

(51) Int. Cl.[7] ..... E04B 9/00; E06B 3/54

(52) U.S. Cl. ..... 52/474; 52/200; 52/13; 52/14; 52/235; 52/397; 52/772; 52/468; 52/464; 52/204.53; 52/204.591; 52/204.6; 52/204.62; 52/DIG. 17; 52/204.71; 52/461

(58) Field of Search ..... 52/200, 13, 14, 52/235, 397, 772, 468, 464, 204.53, 204.54, 204.591, 204.6, 204.62, DIG. 17, 204.71, 461

(56) References Cited

U.S. PATENT DOCUMENTS

| | | | | |
|---|---|---|---|---|
| 3,844,087 A | | 10/1974 | Schultz et al. | |
| 4,123,883 A | | 11/1978 | Barber, Jr. et al. | |
| 4,251,964 A | | 2/1981 | Franics | |
| 4,327,532 A | | 5/1982 | Matthews | |
| 4,607,567 A | | 8/1986 | Esposito | |
| 4,671,027 A | * | 6/1987 | Esposito | 52/86 |
| 4,724,646 A | | 2/1988 | Meyers | |
| 4,756,127 A | | 7/1988 | Helterbrand et al. | |
| 4,850,167 A | | 7/1989 | Beard et al. | |
| 4,884,376 A | | 12/1989 | DeBlock et al. | |
| 4,918,882 A | | 4/1990 | Funk | |
| 5,568,707 A | | 10/1996 | Ishikawa et al. | |
| 5,797,225 A | | 8/1998 | Ishikawa | |
| 5,913,785 A | | 6/1999 | Møller et al. | |
| 5,927,027 A | | 7/1999 | Richardson | |

* cited by examiner

*Primary Examiner*—Beth A. Stephan
*Assistant Examiner*—Chi Q. Nguyen
(74) *Attorney, Agent, or Firm*—Watts, Hoffmann, Fisher & Heinke Co.

(57) ABSTRACT

A containment structure for providing fluid tight seals between translucent panels and a frame and between the frame and an adjoining structural member. The containment structure includes an L-shaped gasket for providing a seal on a first side of the translucent panel, an upper gasket for providing a seal on a second side of the translucent panel, one or more connector plates for connecting the frame to an adjoining structural member, a structural carrier gasket for providing a seal between the frame and an adjoining structural member and a connector plate gasket for providing seals between the one or more connector plates and the adjoining structural member.

28 Claims, 11 Drawing Sheets

CONTAINMENT FRAMING SYSTEM

TECHNICAL FIELD

The present invention relates to a containment framing and gasketing system for mounting translucent panels and, more particularly, the present invention relates to a containment framing and gasketing system that provides a fluid tight seal between the containment framing and gasketing system and one or more translucent panels.

BACKGROUND ART

Prior art greenhouse glazing systems utilize a lapped shingle approach to mount glass panels to a greenhouse frame. The lapped shingle approach employs a frame having vertically extending members for mounting the glass panels. An elastic putty material, or rope putty, is applied to the vertically extending members. A lower glass panel is mounted between two vertically extending members by the rope putty, such that the lower glass panel is held in place on two sides by two vertically extending members. A second glass panel is similarly mounted to the two vertically extending members, such that the bottom of the second glass panel overlaps the top of the lower glass panel. A cap is applied to the glass panels to hold them in place. Panels are added in this manner until the sides and roof of the greenhouse frame are covered with glass panels.

When the lapped shingle approach is used, only two sides of the glass panels are sealed by rope putty. The lapped shingle approach does not provide any sealing between the upper and lower edges of adjoining panels. Contaminants easily enter and exit through gaps between adjacent panels. The gaps between panels widen when slightly warped panels are used or as the panels bow over time.

The rope putty used to mount the glass panels to the frame frequently must periodically be replaced as it dries out. The rope putty also must be replaced when the glazing glass needs to be replaced because of breakage.

Typically greenhouses weep condensation to the outside of the greenhouse structure through weep holes. Insects and other plant materials that are inside the greenhouse may escape or be released to the outside environment. In addition, plant and insect materials on the outside of a typical greenhouse structure can enter the inside of the geenhouse structure through the weep holes.

Typical greenhouses utilize flashing and caulking material to connect adjoining structural members. The caulking is porous and does not form an air tight seal.

Additionally, ultra-violet light causes the caulking to break down over time. This allows air filtration between the individual components of a greenhouse.

Framing systems have been used in conjunction with rubber gaskets to mount translucent panels. For example, U.S. Pat. No. 4,756,127 shows a universal framing system adapted for use with glazing having substantially any thickness within a wide range of thicknesses. The framing system includes a holder on a flange that holds a flexible sealing gasket in sealing engagement with the front face of a translucent sheet.

U.S. Pat. No. 4,123,883 is directed to a solar energy collector. The housing for the solar energy collector is formed of one piece wall sections having integral flashing regulets. The regulets are formed to provide lifting surfaces for the housings, help define a securing channel on the housing and aid in positioning a transparent cover retaining cap on the walls. The retaining cap holds down a transparent cover member having a sealing member about its edge to form a weather tight seal.

DISCLOSURE OF INVENTION

The present invention -concerns a containment framing gasketing system for providing fluid tight seals between translucent panels and a frame and between structural members of the frame and adjoining structural members. The containment framing gasketing system includes L-shaped gaskets that work in conjunction with upper gaskets to provide fluid tight seals between the translucent panels and the frame. The containment structure also includes connector plates that works in conjunction with structural carrier and connector plate gaskets to form a fluid tight seals between the structural members of the frame and an adjoining structural member.

The containment frame includes structural carrier members that support the weight of the translucent panels and pressure bars which hold the panels in place. Each L-shaped gasket includes one or more projections extending from a surface that engages a structural carrier member. The one or more projections extending from the L-shaped gaskets are inserted into corresponding one or more channels in structural carrier members to connect the L-shaped gaskets to the structural carrier members. Each L-shaped gasket includes a glass sealing surface and a gasket sealing surface. After the L-shaped gaskets have been connected to the structural carrier members of the containment frame, the translucent panels are placed on the L-shaped gaskets. The glass sealing surface of each L-shaped gasket engages a first side of a translucent panel. The glass sealing surfaces of each L-shaped gasket may include a plurality of deformable teeth for sealing the first side of the translucent panel at a plurality of locations.

After the translucent panels have been placed on the L-shaped gaskets, the upper gaskets are applied to the pressure bars. The upper gaskets include one or more projections for insertion into corresponding one or more channels in the pressure bars. Once the upper gaskets have been assembled to the pressure bars, the pressure bar assemblies are mounted to the containment frame, such that a glass sealing surfaces of the upper gaskets engages a second side of the translucent panels to provide seals between the upper gaskets and the second sides of the translucent panels. The sealing surface of each upper gasket also contacts a gasket sealing surface of a corresponding L-shaped gasket to form a seal between each pair of L-shaped and upper gaskets. The glass engaging surface of each upper gasket may include a plurality of deformable teeth for contacting a plurality of locations on the second side of a translucent panel.

The surfaces of the L-shaped gaskets that engages the glass contacting surfaces of the upper gasket may include a pluralities of deformable teeth that engage the deformable teeth of the upper gaskets to form a seal. The corners of the L-shaped gaskets and upper gaskets are bonded together to form seals around the corners of the translucent panels.

To form a fluid tight seal between structural carrier members of the framing system and an adjoining structural member, connector plates are connected to the base of the structural carrier members. The connector plates may include ridges that are inserted into channels in the structural carrier members. The structural carrier gaskets each have a first side that is inserted into the channel in a structural member. A second side of each structural carrier gasket extends from the channel to contact an adjoining structural member to form a fluid tight seal between the structural carrier member and the adjoining structural member when the connector plate is fastened to the adjoining structural member. The connector plates each include a channel defined in base, into which a first side of a connector plate gasket is inserted. A second side of each connector plate gasket extends from the channel in the connector plate to contact the adjoining structural member, to form a fluid tight seals between the connector plates and the adjoining structural member when the connector plates are fastened to the adjoining structural member. The structural carrier gaskets and the connector gaskets may include pluralities of deformable teeth for contacting and forming seals at a plurality of locations on the adjoining structural member.

A containment frame gasketing system constructed in accordance with the present invention facilitates seating and sealing of glass or plastic panels to the framing structure in such a manner to prevent leakage of air and water and to contain undesirable elements from escaping into the atmosphere. The gasketing system is more durable than typical systems which use rope putty. The gaskets do not need to be replaced in the event that the glazing needs to be repaired or replaced. The system of the present invention also captures the glass on all four sides to prevent air filtration into and out of the structure. In addition, the system of the present invention captures the bottom of the glass with the L-shaped gasket, which extends up the edge of the glass to interlock with the top gasket which seals the top of the glass. This produces a much better seal, since the two gaskets are sealed, the top and the bottom of the translucent panel are sealed and the edge of the translucent panels are not exposed. The edges of the glass are completely enclosed, preventing internal elements from escaping the containment system and external elements from entering the system.

Additional features of the invention will become apparent and a fuller understanding obtained by reading the following detailed description in connection with the accompanying drawings.

BEST MODE FOR CARRYING OUT THE INVENTION

Figure 1:
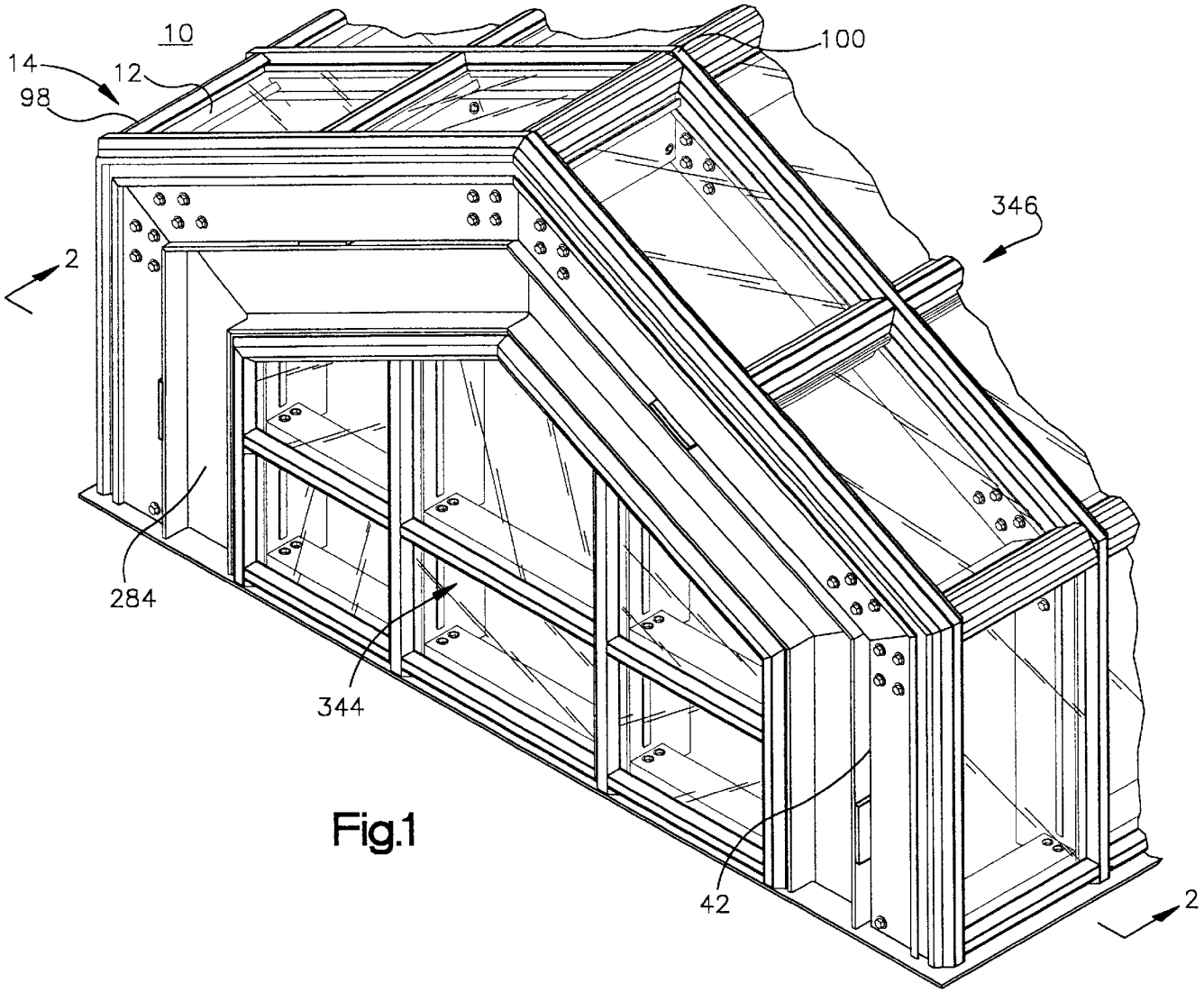
FIG. 1 is a perspective view of a containment framing system constructed in accordance with the present invention.

The present invention is directed to a containment structure 10 for providing fluid tight seals between translucent panels 12 and a frame 14 that together make up the structure. The structure shown in FIG. 1 is a greenhouse. The frame 14 includes structural carrier members 16 and pressure bars 18. The containment structure 10 also provides fluid tight seals between the structural carrier members 16 and adjoining structural members 20.

As seen most clearly in FIGS. 9A–9D, L-shaped gaskets 22 that work in conjunction with upper gaskets 24 to provide the fluid tight seals between the translucent panels 12 and the frame 14. Each L-shaped gasket 22 includes a structural carrier member engaging surface 26 for connecting the L-shaped gasket 22 to a corresponding structural carrier member 16. Each L-shaped gasket includes a glass sealing surface 28 that provides a seal between the L-shaped gasket 22 and one side of a translucent panel 12. The upper gaskets 24 each include a pressure plate engaging surface 30 for connecting the upper gaskets 24 to the pressure plates 18. The upper gaskets 24 each include a glass sealing surface 32 that provides a seal between the upper gasket 24 and second side 13*b* of the translucent panels 12. The glass sealing surface 32 of each upper gasket 24 also makes contact and seals the upper gasket 24 to a top surface 34 of a corresponding L-shaped gasket 22.

Connector plates 36 (FIGS. 2, 12, 13) are used in conjunction with structural carrier gaskets 38 and connector plate gaskets 40 to seal the structural carrier members 16 to the adjoining structural members 20. Each connector plate 36 is connected to a base 42 of a structural carrier member 16. The structural carrier gaskets 38 each have a first side 44 that fits in a channel 46 in the base 42 of one of the structural carrier members 16. Each structural carrier gasket 38 has a second side 48 for contacting an adjoining structural member 20. Each connector plate gasket 40 has a first side 50 and a second side 52. The first side 50 of each connector plate gasket is adapted to fit in a channel 54 of a corresponding connector plate 36. The second side 52 of each connector plate gasket 40 is adapted to contact an adjoining structural member 20. Fluid tight seals are formed between the second sides 48 of the structural carrier gaskets and adjoining structural members 20, and between second sides 52 of the connector plates gasket 40 and adjoining structural members 20, when the connector plates 36 are fastened to one or more adjoining structural members 20.

Referring to FIGS. 9A, 9B, 9C and 9D, the structural carrier members 16 comprise rafters 56 and purlins 58. Rafters 56 extend vertically on the sides 15 of the frame and at an incline on the top 17 of the frame. The purlins 58 are the horizontally extending members of the containment frame 14. In the exemplary embodiment, four types of purlins and one type of rafter is used to construct the frame 14. The four types of purlins are intermediate purlins 60, ridge purlins 62, knee purlins 64 and sill purlins 66, and only one type of rafter.

Figure 9A:
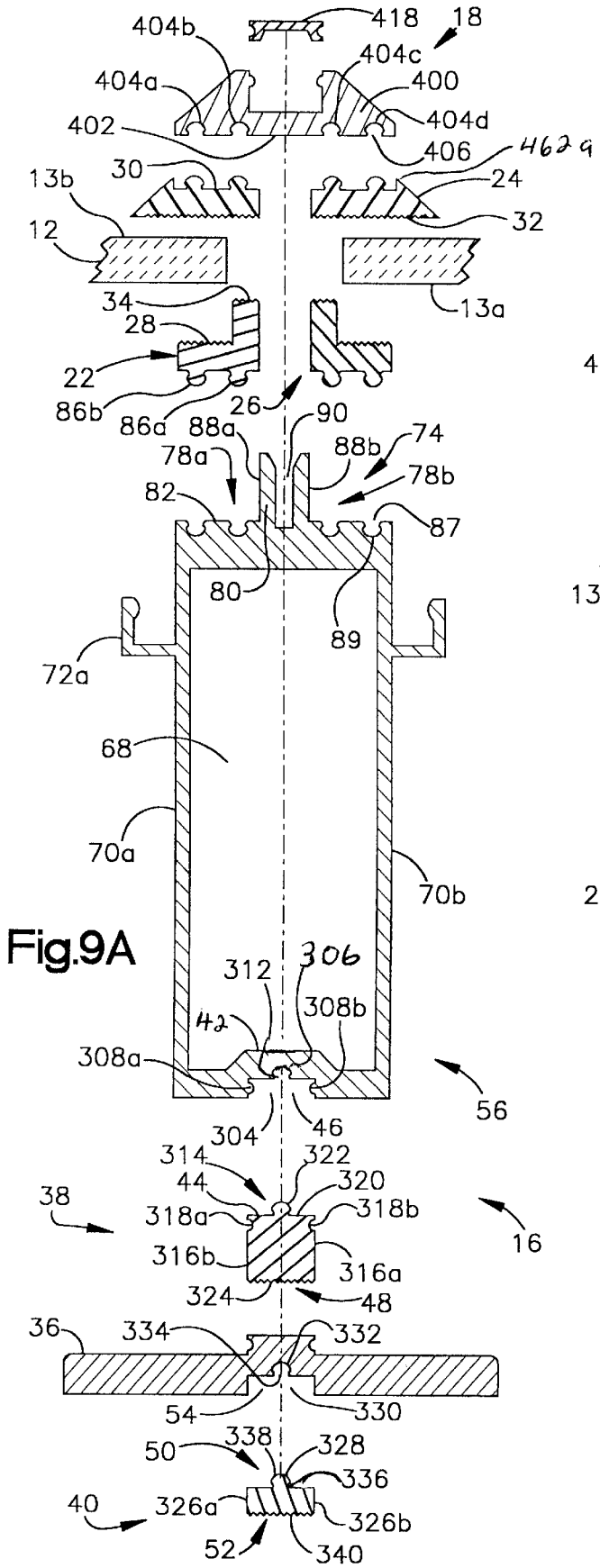
FIG. 9A is an exploded front elevational view of the assembly of a cap, a rafter pressure plate, an upper gasket, a translucent panel, a lower L-gasket, a rafter, a bottom rafter gasket, a rafter connector plate, and a connector plate gasket.

Referring to FIG. 9A, each rafter 56 includes a rectangular tubular portion 68. The rectangular tubular portion 68 includes a base 42 that has a channel 46 in it for mounting structural carrier gaskets 38 and rafter connector plates 36. On the sides 70*a*, 70*b* of each tubular member 68 are drip gutters 72*a*, 72*b* that extend outward and upward from the sides 70*a*, 70*b*. The drip gutters 72 channel moisture that condenses in the containment apparatus 10 on the first sides 13*a* of the translucent panels 12 away from the translucent panels 12. A top section of a rafter 56 is known as the glazing profile 74. The glazing profile 74 is divided into two L-shaped gasket accommodating portions 78*a*, 78*b*, by a screw boss 80 that extends upward from the glazing profile. The top 82 of each L-shaped gasketing accommodating portion 78*a*, 78*b* includes two channels for capturing projections 86*a*, 86*b* on an L-shaped gasket 22 to connect the L-shaped gasket 22 to the glazing profile 74. The channels 78*a*, 78*b* in each structural carrier member include a passage 87 that extends into a semi-circular opening 89. The special shape of the channels 78*a*, 78*b* facilitate locking engagement of each L-shaped gasket to each structural carrier member 16. The screw boss 80 includes two sides 88*a*, 88*b* and an inner screw engaging cavity 90 which may include serrations. In the exemplary embodiment, the rafters, as well as each of the other structural carrier members, are extruded aluminum.

Figures 3, 4:
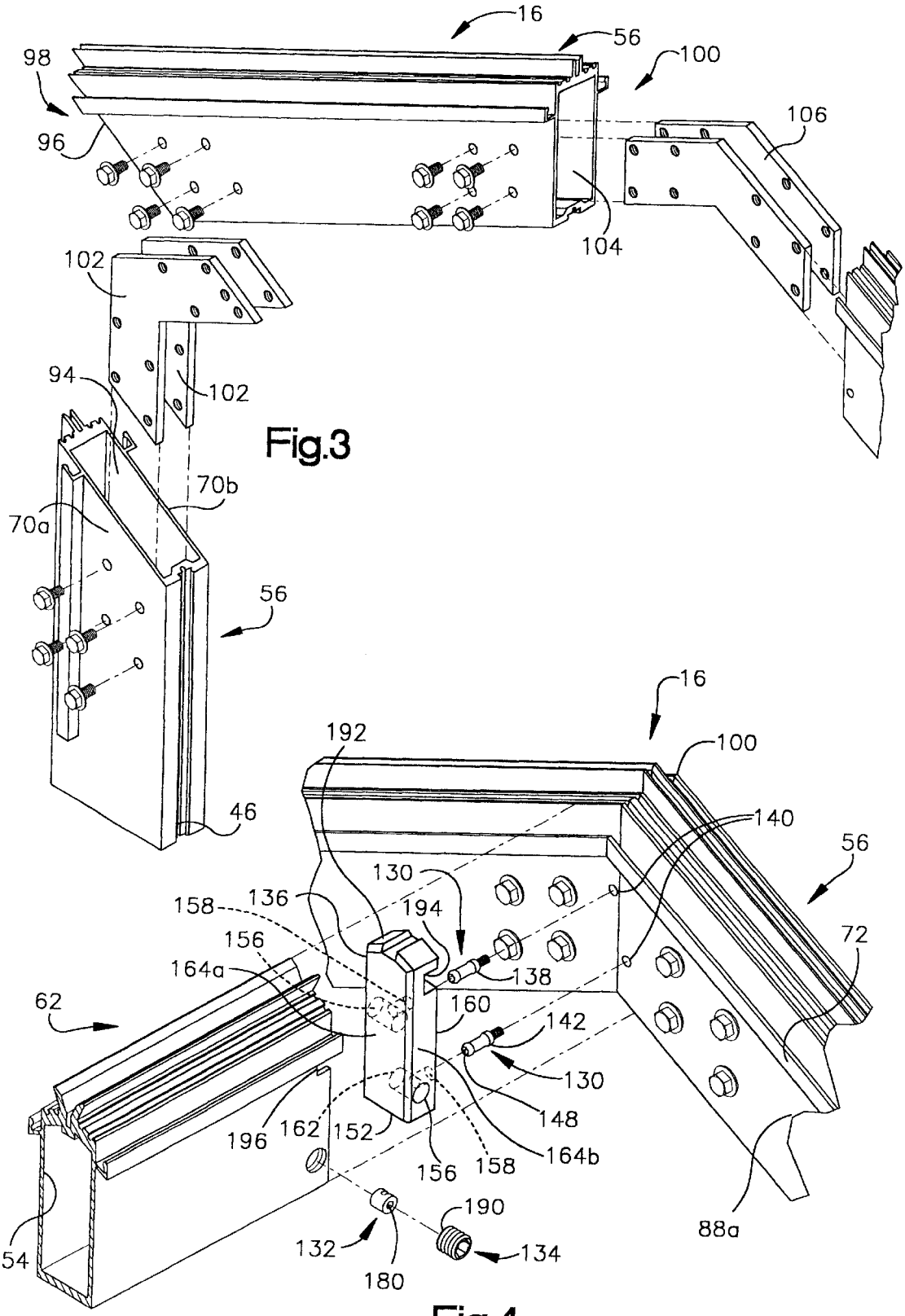
FIG. 3 is an exploded perspective view of a rafter assembly.
FIG. 4 is an exploded perspective view of a ridge purlin assembled to a rafter assembly.

Referring to FIG. 3, the rafters 56 which form sides of the containment framing system 10 are mitered at top ends 94 to mate with first mitered ends 96 of the rafters 56 that extend from a knee 98 of the containment framing system 10 to a ridge 100 or peak of the containment framing system 10. The rafters 56 are assembled together at the knee 98 using knee connector plates 102. The knee connector plates 102 are flat metal plates in the shape of a "V." The angle defined by the knee connector plates corresponds to the desired angle of the knee 98 of the frame 14. The knee connector plates 102 are inserted into the rectangular tubular portion 68 of the rafters 56. Preferably, two knee connector plates are used at each joint. The knee connector plates 102 are then mechanically fastened to the sides 70*a*, 70*b* of the rectangular tubular portions 68 of the rafters 56.

The top ends 94 of the rafters 56 that extend vertically and the first mitered end 96 of rafters 56 that extend from the knee 98 to the ridge 100 are brought into tight engagement, when the rafters 56 are connected by the knee connector plates 102. By utilizing the rectangular tubular portion 68 of the rafters 56 to connect the raters 56, air is prevented from escaping the containment framing system 10 since the glazing profile 74 of the rafters 56 does not include connecting holes.

It should be apparent that the rafters 56 without rectangular tubular portions 68 could be fastened together using conventional mechanical means to fasten the glazing profiles 74 of the rafters and other structural carrier members 16 together. However, the rectangular tubular portions 68 of the rafters 56 make assembly easier. If rafters 56 and other structural carrier members 16 that do not include rectangular tubular portions 68 are used, the connectors used to connect the members together should not pass through the glazing profile, because a passage for air to leak into or out of the structure could be created.

Second ends 104 of the rafters 56 that extend from the knees 98 to the ridges are mitered to mate with other rafters 56 to form a ridge. The second ends 104 of the rafters 56 are connected together using ridge connector plates 106. The ridge connector plates 106 are flat metal plates in the shape of a "V." The angle defined by the ridge connector plates 106 corresponds to the desired angle of the ridge 100 of the frame 14. The ridge connector plates 106 are inserted into the rectangular tubular portion 68 of the rafters 56 and mechanically connected, similar to the connection of the rafters 56 at the knee 98. The connection of the rafters 56 by the ridge connector plates 106 brings second mitered ends 104 of pairs of rafters into tight engagement.

Figure 9B:
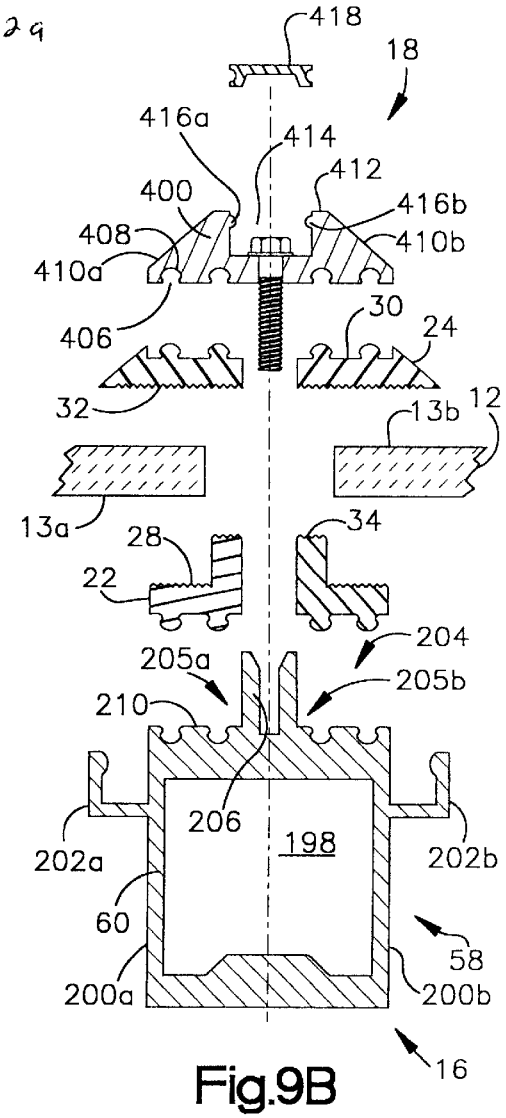
FIG. 9B is an exploded front elevational view of the assembly of a cap, an intermediate purlin pressure plate, an upper gasket, a translucent panel, a lower L-gasket, and an intermediate purlin.
Figure 9C:
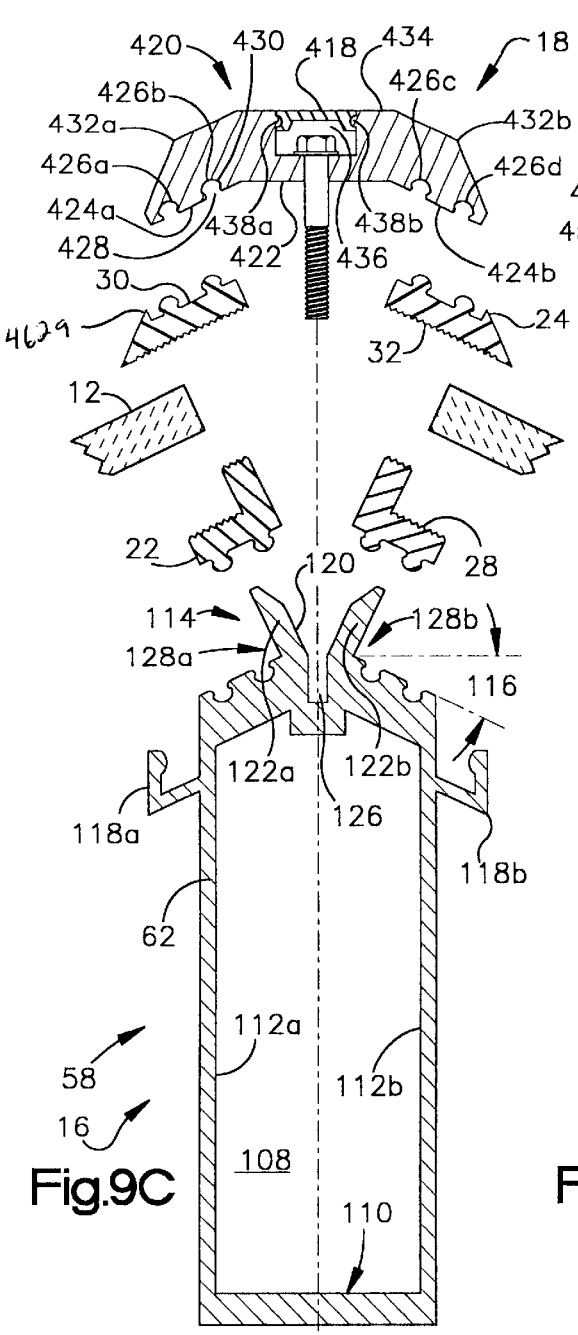
FIG. 9C is an exploded front elevational view of the assembly of a cap, a ridge purlin pressure plate, an upper gasket, a translucent panel, a lower L-gasket, and a ridge purlin.

Referring to FIG. 9C, the ridge purlins 62 are similar in shape to the rafters 56, The ridge purlins 62 each include a rectangular tubular portion 108 having a bottom 110 and two sides 112*a*, 112*b*. The glazing profile 114 of each ridge purlin 62 defines a slope 116 that corresponds to the angle defined by the connection of the rafters 56 at the ridge 100. The drip gutters 118*a*, 118*b* of the ridge purlins 62 extend away from the sides 112*a*, 112*b* of the ridge purlins 62 at the angle of the ridge 100. A screw boss 120 of each ridge purlin 62 includes sides 122*a*, 122*b* that extend generally upward at an angle, with respect to the horizontal, equal to the complement of the angle formed by the ridge 100. The screw boss 120 includes a cavity 126 which may or may not be serrated for connecting screws. The sides 122*a*, 122*b* of the screw bosses 120 of the ridge purlins 62 and the top surfaces of the glazing profiles 114 form L-shaped gasket accommodating surfaces 128*a*, 128*b*. Although, at an angle, the L-shaped gasket accommodating surfaces 128*a*, 128*b* of the ridge purlins 62 are the same as the L-shaped gasket accommodating portions 78*a*, 78*b* of the rafters 56. This allows the same L-shaped gaskets 22 to be used on the ridge purlins 62 as are used on the rafters 56. In the exemplary embodiment, the ridge purlins are extruded aluminum.

Figure 8:
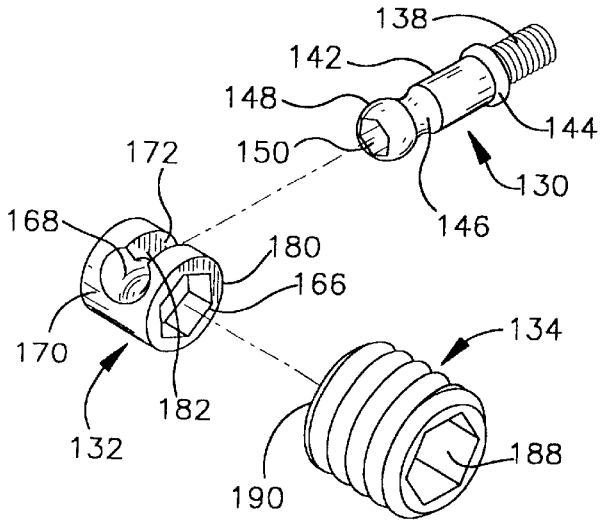
FIG. 8 is a perspective view of a ball lock pin, a ball lock and a hex head set screw.

Referring to FIGS. 4 and 8, the ridge purlins 62 are assembled to the rafters 56 at the ridge 100 with a ridge connector blocks 136, two ball lock pins 130, two ball locks 132, and two hex head set screws 134. Threaded ends 138 of two ball lock pins 130 are threaded into two corresponding threaded holes 140 in the rafters 56 that form a ridge 100. Extending from the threaded ends 138 of the ball lock pins 130 are short cylindrical portions 142, having diameters that are larger than the diameters of the threaded ends 138. Shoulders 144 are formed on the ball lock pins 130 at a transition between the threaded ends 138 and the short cylindrical portions 142. The shoulders 144 on the ball lock pins 130 abut a side 88*a* or 88*b* of the rafter 56 when the ball lock pins 130 is tightly screwed into the threaded holes 140 in the rafter 56. Extending from the large cylindrical portion 142 of each ball lock pin 130 is a tapered cylindrical portion 146 which transitions into a ball portion 148 at the end of each ball lock pin 130. The end 150 of each ball portion 148 is keyed to accept a hex driver for driving the ball lock pin 130 into a threaded hole 140 in the rafter 56.

Referring to FIG. 4, after the two ball lock pins 130 are fastened to the rafters 56, a ridge connector block 136, containing two ball locks 132 is placed over two ball lock pins 130. The ridge connector block 136 is a solid block having an outer surface contour 152 that conforms with an inner surface 154 of the rectangular tubular portion 108 of a ridge purlin 62. The contour 152 of the ridge connector block 136 is slightly smaller than the inner surface 154 of the rectangular tubular portion 108 of the ridge purlin 62, so that it may easily be inserted into the rectangular tubular portion 108 of the ridge purlin 62. Each ridge connector block 136 includes two threaded holes 156 into which the ball locks 132 are inserted. The ridge connector block 136 also includes two smaller unthreaded holes 160 in the front of the ridge connector block. The two smaller holes 160 are aligned with the central axes of the threaded holes 156 in the sides 164*a*, 164*b* of the ridge connector block and intersect the threaded holes 156 near the bottom 162 of the threaded holes 156. The unthreaded holes 158 define a passage through the front 160 of the ridge connector block into the perpendicular threaded holes 156 for the ball lock pins 130 to be inserted. When the ridge connector block 136 is placed over the two ball lock pins 130 the ball portions 148 extend into the perpendicular threaded holes 156 of the ridge connector block 136.

Each of the two ball locks 132 is a short cylindrical member that fits in the threaded holes 156 in the ridge connector block 136. The first end 166 of each ball lock 132 is keyed to accept a small hexagonal wrench. A round blind hole 168 is machined in a cylindrical side 170 of the ball lock 132. The round blind hole 168 is centered on the ball lock 132 and extends approximately ¾ of the way through the ball lock 132. The round blind hole 168 is slightly larger than the ball portion 148 of the ball lock pin 130. The cylindrical side 170 of the ball lock 132 also includes a reduced diameter slot 172 that extends from the round blind hole 168 around a portion of the cylindrical side 170 of the ball lock 132. The round blind hole 168 of the ball locks 132 are large enough to fit over the ball portion 148 of the ball lock pins 130. The reduced diameter slot 172 is smaller than the diameter of the ball portion 148, but is larger than the tapered cylindrical portion 146 of the ball lock pins 130.

Two ball locks 132 are used to mount each ridge connector block 136. The ball locks 132 are inserted into the two threaded holes 156 of the ridge connector block 136, and are oriented such that the round blind holes 168 are aligned with the unthreaded holes 158 in the ridge connector block 136. The unthreaded holes 158 in the ridge connector block 136 are placed over the two ball lock pins 130 assembled to the rafters 56 at the ridge 100. The ball portions 148 of the ball lock pins 130 extend into the round blind holes 168 into the center of the ball locks 132. Once the ridge connector block 136 is in place, each ball lock 132 is rotated using a hex driver. Each ball lock includes an area of transition 182 between the blind hole 168 and the reduced diameter slot 172 that engages a portion 184 of the ball portion 148 abutting the tapered cylindrical portion 146 to bring the ridge connector block 136 into tight engagement with the side 70*a* or 70*b* of the rafter 56. The rectangular tubular portion 108 of the ridge purlin 62 is placed over the ridge connector block 136, such that threaded holes 186 in the ridge purlin 62 are aligned with the threaded holes 156 in the ride connector block 136. Two hex head set screws 134 are threaded through the threaded holes 186 in the ridge purlin and into the threaded holes 140 in the rafters 56, to connect each ridge purlin 62 to the ridge purlin connector block 136 and rafters 56.

Each hex head screw 134 has a large hexagonal cut-out 188 through its center. The large hexagonal cut-out 188 allows a hex driver to be used to connect the ridge purlin 62 to the ridge connector block 136. When the hex head set screw 134 is torqued, an end 190 contacts an exposed end 180 of the ball lock 132 to frictionally engage the ball lock 132 and lock the ridge purlin 62 in place.

Once the ridge purlin 62 has been assembled to the rafters 56, the ridge purlin 62 and ridge connector block 136 can be disassembled as a unit by slightly untightening the hex head set screws 134 and rotating the ball locks 132 with a hex driver that fits through the large hexagonal cut-out 188 in the hex head screw 134.

In an exemplary embodiment, two ball locks 132 are inserted into the ridge connector block 136. The ridge connector block 136 is then be inserted into the rectangular tubular portion 108 of a ridge purlin 62 and loosely connected to the ridge purlin 62 with two hex head set screws 134. The ball locks 132 are adjusted using a tool that fits through the large hexagonal cut-out 188 of the hex head set screw 134 to align the ball locks 132 with the unthreaded holes 158 in the ridge connector block 136. The ridge purlin 62 and ridge connector block 136 assembly is then placed over two ball lock pins 130 that are assembled to the rafters 56. The ball locks 132 are rotated using a tool which fits through the large hexagonal cut-out 188 in the hex head set screw 134 to pull the ridge purlin 62 and ridge connector block 136 assembly into tight engagement with the rafter 56. The hex head set screws 134 are then torqued down to lock the assembly of the ridge connector block 136 and ridge purlin 62 to the rafter 56.

At the top 192 of each ridge connector block 136 there is an inverted V-shaped notch 194. The angle of the inverted V-shaped notch 194 corresponds to the angle of the ridge 100. When the ridge connector block 136 is assembled to the rafters 56 at the ridge 100, the inverted V-shaped notch 194 fits over the drip gutters 72 of the rafters 56, allowing the front 160 of each ridge connector block 62 to mount tightly against a side 88*a* or 88*b* of the rafters 56. The rectangular tubular portion 108 of the ridge purlin 62 includes two cut-outs 196. The cut-outs 196 in the ridge purlin 58 are aligned with the V-shaped notch 194 of the ridge connector block 136, when the ridge purlin 62 is assembled to the ridge connector block 136. The cut-outs 196 in the ridge purlin 62 fit over the drip gutters 72 of the rafters 56. The assembled ridge purlins 62 and ridge connector blocks 136 fit over the drip gutter 72 of the rafters 56 and mount tightly against the rafters 56. When mounted to the rafters 56, the drip gutters 118 of the ridge purlin 62 are above the drip gutters 72 of the rafters 56 that meet at the ridge 100.

Referring to FIG. 9B, each intermediate purlin 60 includes a smaller rectangular tubular portion 198, having two sides 200*a*, 200*b*. Extending from the two sides 200*a*, 200*b* are drip gutters 202*a*, 202*b*. At the top of the rectangular tubular portion 198 of each intermediate purlin 60, is the glazing profile 204. The glazing profile 204 of an intermediate purlin 60 is identical to the glazing profile 74 of a rafter 56. The top 210 of an intermediate purlin glazing profile 204 is planar, like the top 82 of the rafter 56. The screw boss 206 is the same as the screw boss of a rafter 56. Since the glazing profile 204 of an intermediate purlins 60 is the same as the glazing profile 74 of a rafter 56, the L-shaped gasket accommodating portions 205*a*, 205*b* are the same, allowing the same L-shaped gasket to be used for a ridge purlin 62 as is used for a rafter 56. As seen in FIGS. 9A–9D, the L-shaped gasket accommodating portions for each type of structural carrier member 16 are the same, allowing the same L-shaped gasket to be used for every structural carrier member.

The drip gutters 202*a*, 202*b* of an intermediate purlin 60 are higher with respect to the glazing profile 204 than the drip gutters 72 of a rafter 56. When the intermediate purlins 60 are assembled to the rafters 56, the drip gutters 202 of the intermediate purlins 60 are disposed above the drip gutters 72 of the rafters 56.

Figure 5:
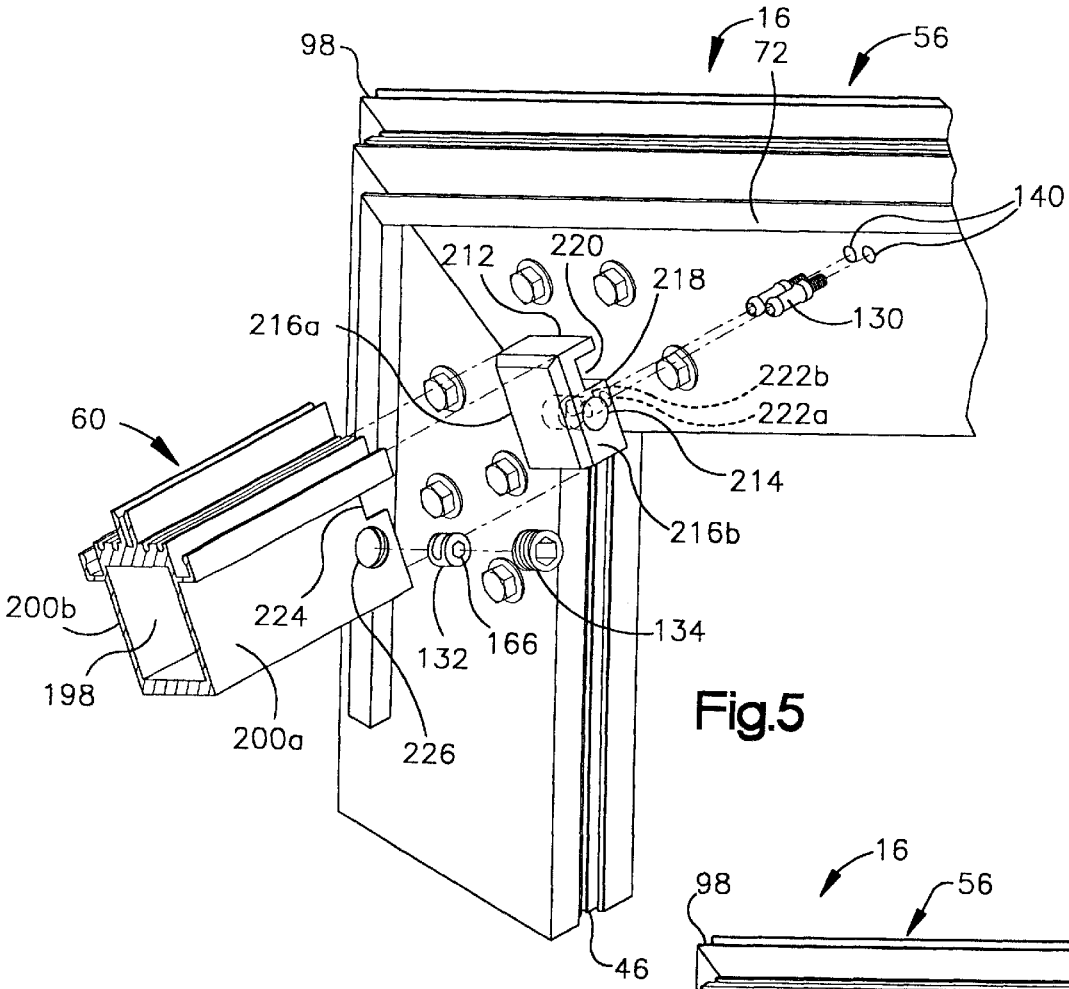
FIG. 5 is an exploded perspective view of an intermediate purlin assembled to a rafter assembly.

Referring to FIG. 5, an intermediate purlin 60 is assembled along a span of one of the rafters 56 using the same connection method that is used in assembling the ridge purlins 62. An intermediate connector block 212 is used in conjunction with two ball lock pins 130, two ball locks 132 and two hex head set screws 114 to mount an intermediate purlin to a rafter 56. The intermediate connector block 212 is sized to fit within the rectangular tubular portion 198 of the intermediate purlin 60. Each intermediate connector block 212 includes a threaded hole 214 that passes through sides 216*a*, 216*b* of the intermediate purlins connector block 212. The face 218 of each intermediate purlin connector block 212 includes a notch 220 sized to fit over a drip gutter 72 of a rafters 56. Also in the face 218 of each intermediate connector block 212 are two holes 222*a*, 222*b* sized to fit over ball lock pins 130. The holes 222*a*, 222*b* are perpendicular to the threaded hole 214, are aligned with the axis (not shown) of the threaded hole 214, and intersect the threaded hole 214.

The intermediate purlin connector block 212 may be attached to the rafter 56 first, or in the exemplary embodiment, the intermediate purlin connector bock 212*a*, 212*b* is attached to the intermediate purlin 60 first. The intermediate purlin 60 includes notches 224 that clear the drip gutter 72 of the rafter 56. Two ball lock pins 130 are threaded through threaded holes 140 in the rafters 56. Two ball locks 132 are inserted into the threaded hole 214 in the intermediate connector block 212. The first end 166 of each ball lock 132, adapted to accept a hex wrench, faces outward. The intermediate purlin connector block 212 is then inserted into the rectangular tubular portion 198 of the intermediate purlin 60 until the threaded hole 214 of the intermediate connector block 212 is in alignment with the threaded holes 226 in each side 200*a*, 200*b* of the intermediate purlin 60. The notches 224 in the intermediate purlins 60 are aligned with the notch 220 in the intermediate connector block 212 when the intermediate connector block 212 is assembled to the intermediate purlin 60. Two hex head set screws 134 are threaded through the threaded holes 226 in the intermediate purlin 60 and loosely threaded into the threaded hole 214 in the intermediate connector block. The ball locks 132 are rotated with a small hex wrench, to align the round blind hole 168 in the ball lock 132 with the holes 222*a*, 222*b* in the intermediate connector block 212.

The assembled intermediate purlin 60 and the intermediate connector block 212 are then placed over the two ball lock pins 130 in the rafter 56 and the drip gutter 72. The two ball locks 132 are rotated with a small Allen wrench (not shown) to bring the assembled intermediate connector block 212 and intermediate purlin 60 assembly into tight engagement with the rafter 56. The two hex head set screws 134 are then tightened down onto the two ball locks 132 to lock the intermediate connector block 212 and intermediate purlin 60 in place. Like the assembly of a ridge purlin 62 to rafters 56, an assembled intermediate connector block 212 and intermediate purlin 60 can be removed from the rafter 56 by loosening the hex head screws 134 and rotating the ball locks 132.

Figure 9D:
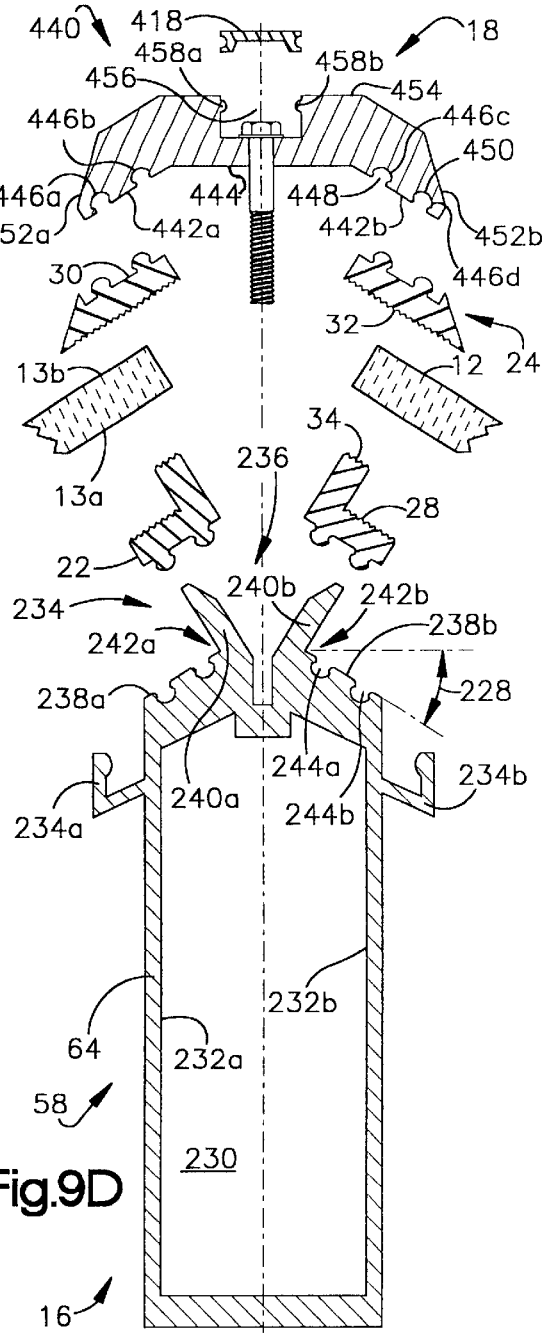
FIG. 9D is an exploded front elevational view of the assembly of a cap, a knee purlin pressure plate, and upper gasket, a translucent panel, a lower L-gasket, and a knee purlin.
Figure 9E:
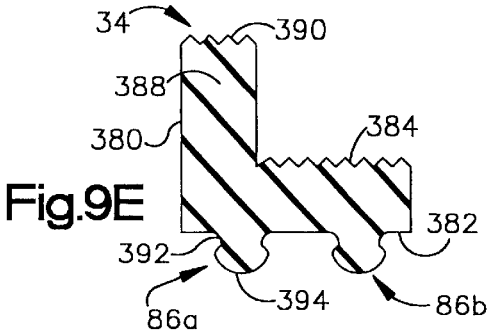
FIG. 9E is an enlarged cross-sectional view of a lower L-gasket.

Referring to FIG. 9D, it is apparent that the cross-section of a knee purlin 64 is similar to the cross-section of a ridge purlin 62. The main difference between the ridge purlins 62 and the knee purlins 64 is the difference in slope of the glazing profiles. The slope 116 of a ridge purlin 62 is defined by the angle formed by intersecting rafters 56 at the ridge 100. The slope 228 of the knee purlins 64 is defined by the angle between intersecting rafters 56 at the knee 98 of the frame 14.

Each knee purlin 64 includes a rectangular tubular portion 230 having two sides 232*a*, 232*b*. Drip gutters 234*a*, 234*b* extend from the sides 232*a*, 232*b* of each knee purlin 64 at an angle equal to the slope 228 of the knee purlin 64. The glazing profile 234 of a knee purlin 64 is divided in half by a screw boss 236. The top surfaces 238*a*, 238*b* of the knee purlin glazing profile 234 form an angle equal to the angle of the knee 98. Sides 240*a*, 240*b* of the screw boss 236 extend upward at an angle, measured from the horizontal, equal to the complement of the angle defined by the knee 98. The top surfaces 238*a*, 238*b* of the glazing profile 234 and the sides 240*a*, 240*b* of the screw boss 236 define L-shaped gasket accommodating surfaces 242*a*, 242*b*. The top surfaces 238*a*, 238*b* each include channels 244*a*, 244*b* for connection of L-shaped gaskets 22. The L-shaped gasket accommodating surfaces of the knee purlin are the same as the L-shaped gasket accommodating surfaces of the other structural carrier members 18, allowing the same L-shaped gasket 22 to be used. The knee purlins are extruded aluminum profiles.

Figure 6:
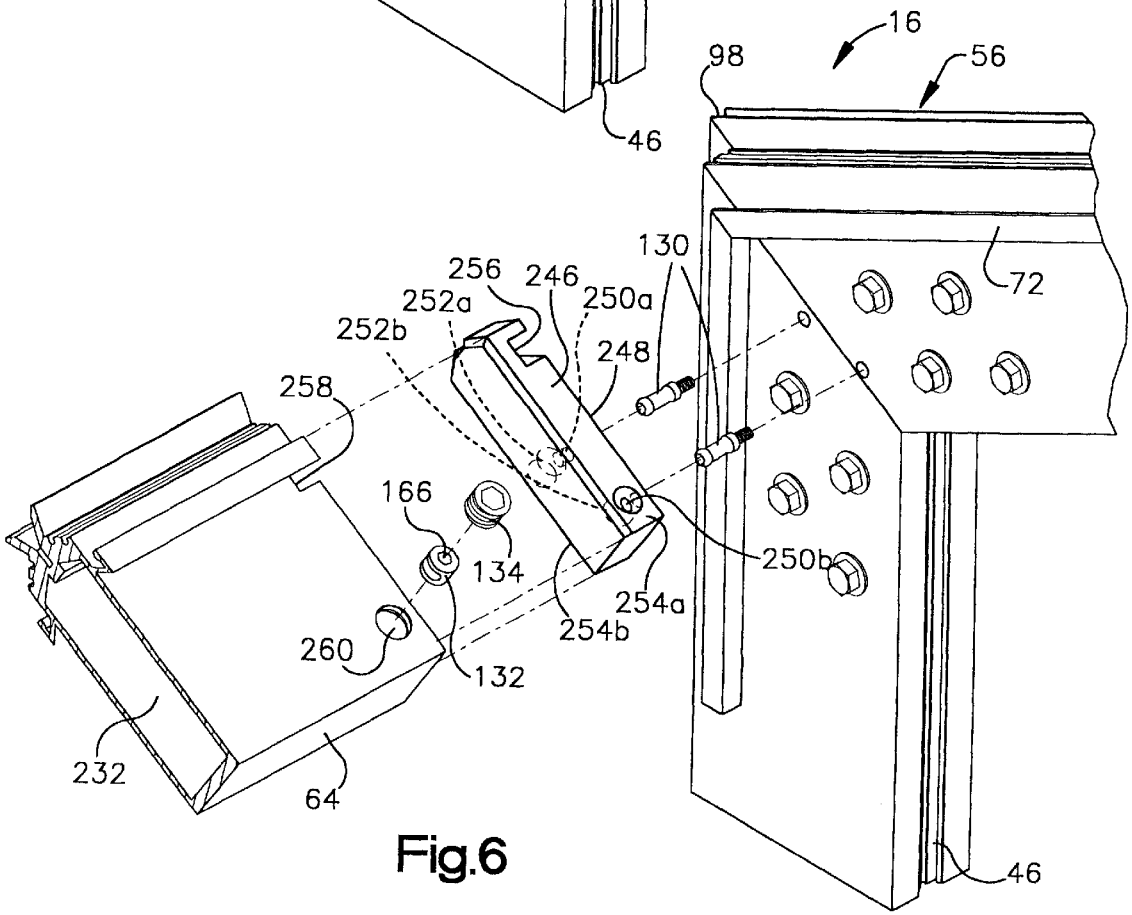
FIG. 6 is an exploded perspective view of a knee purlin assembled to a rafter assembly.

Referring to FIG. 6, the same method is used to assemble a knee purlin 64 to rafters 56 at the knee 98, as is used to assemble a ridge purlins 62 to rafters 56 at the ridge 100. A knee connector block 246 is used in conjunction with two ball lock pins 130, two ball locks 132 and two hex head set screws 134 to connect each knee purlin 64 to the rafters 56. A face 248 of the knee connector block 246 includes two holes 250*a*, 250*b* that are sized to fit over ball lock pins 130. The knee connector block 246 also includes two threaded holes 252*a*, 252*b* in the connector blocks sides 254*a*, 254*b*. The threaded holes 252*a*, 252*b* extend approximately half way through the connector blocks 246, and are aligned with holes 250*a*, 250*b*. The threaded holes 252*a*, 252*b* are sized to accept ball locks 132.

A knee connector block 246 is sized to fit within the rectangular tubular portion 232 of a knee purlin 64. The face 248 of each connector block 246 includes an inverted V-shaped notch 256. The inverted V-shaped notch 256 forms an angle equal to the angle of the knee 98 and is sized to fit over drip gutters 72 of the rafters 56 at the knee 98. The knee purlin 64 also includes notches 258 that are in alignment with the inverted V-shaped notch 256 of a connector block 246 when a connector block 246 is assembled to the knee purlin 64.

Referring to FIG. 6, to assemble a knee purlin 64 to rafters 56 at the knee, two ball lock pins 130 are threaded into threaded holes 140 in the rafters 56. Two ball locks 232 are placed in the knee connector block 246 threaded holes 252*a*, 252*b*, such that the first ends 166 of the two ball locks 132 face outward, so that the ball locks 132 can be rotated with the hex tool. The connector block 246 with two ball locks 132 in it, is inserted into the rectangular tubular portion 230 of the knee purlin 64. The threaded holes 252*a* 252*b* of the connector block 246 are brought into alignment with threaded holes 260*a*, 260*b* in sides 232*a*, 232*b* of the knee purlin 64. Two hex head set screws 134 are loosely threaded into the threaded holes 260 in the knee purlin 64, and the threaded holes 252*a*, 252*b* in the knee connector block 246. A small hex tool is inserted through the hex head set screws 134 and into the ball lock pin 130 to align the round blind hole 168 of the ball locks 132 with the holes 250*a*, 250*b* in the face 218 of the knee purlin connector block 246. The assembly of a knee purlin connector block 246 and the knee purlin 64 is placed over the two ball lock pins 130 in the rafters 56 that define a knee. The ball locks 132 are rotated to bring the assembly of the knee connector block 246 and knee purlin 64 into tight engagement with the rafters 56. The hex head set screws 134 are then rotated into tight frictional engagement with the ball locks 132 to lock the assembly of a knee connector block 246 and a knee purlin 64 in place. The assembled knee connector block 246 and knee purlin 64 can be removed from the rafter 56 by loosening the hex head screws 134 and rotating the ball locks 132.

Figure 7:
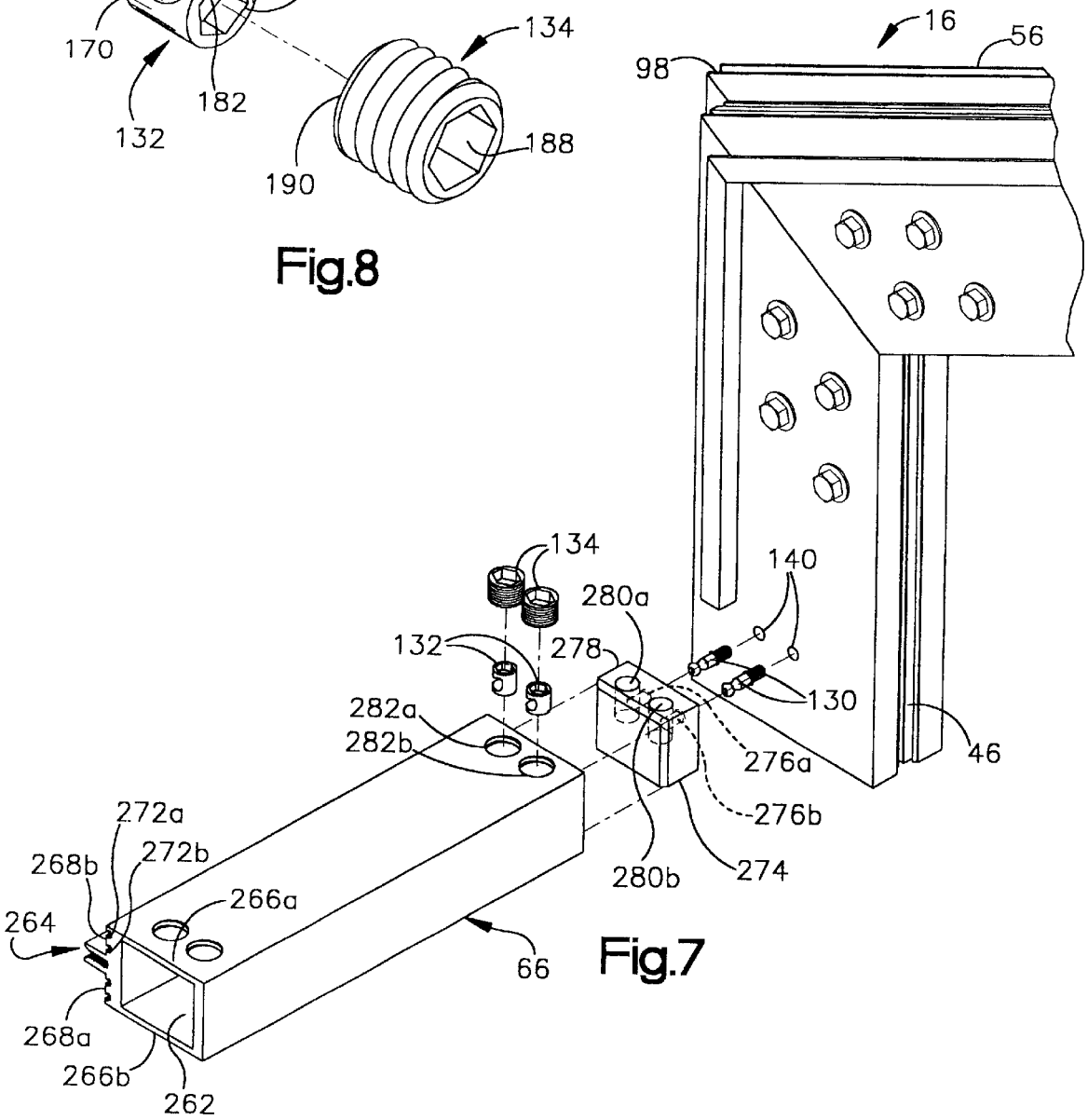
FIG. 7 is an exploded perspective view of a sill purlin assembled to a rafter assembly.

Referring to FIG. 7, sill purlins 66 are used at the bottom of the frame 14. The cross-section of a sill purlin 66 is the same as the cross-section of an intermediate purlins 60, except the sill purlins 66 do not include drip gutters.

The sill purlins 66 include a rectangular tubular portion 262 and a glazing profile 264. The rectangular tubular portion 262 of the sill purlin 66 includes two sides 266*a*, 266*b*. The glazing profile 264 of the sill purlin 66 includes two top surfaces 268*a*, 268*b* and a vertically extending screw boss 270. The top surfaces 268*a*, 268*b* each include channels 272*a*, 272*b* for attachment of L-shaped gaskets 22. The top surfaces 268*a*, 268*b* of the sill purlins 66 are coplanar. Since the glazing profile of a sill purlin 66 is the same as the glazing profiles of the other structural carrier members, the same L-shaped gasket can be used.

Referring to FIG. 7, a sill purlin connector block 274 is used along with two ball lock pins 130, two ball locks 132 and two hex head set screws 134, to connect each sill purlin 66 to a rafter 56. In the exemplary embodiment, the sill purlin connector blocks 274 and the sill purlins 66 do not require notches, since the drip gutters 72 of the rafters 56 are removed at the bottom of the frame 14. In an alternate embodiment (not shown), the drip gutters 72 of the rafters are not removed, and the sill purlins 66 and sill purlin connector blocks include notches (not shown) that clear the drip gutters 72. The face 275 of the sill purlin connector block 274 includes two holes 276*a*, 276*b* that are sized to fit over two ball lock pins 130. One side 278 of the sill purlin connector block 274 includes two threaded holes 280*a*, 280*b* that are sized to accept two ball locks 132. The two holes 276*a*, 276*b* are aligned with and intersect the two threaded holes 280*a*, 280*b* to define passages from the face 275 to the two threaded holes 280*a*, 280*b*.

To assemble a sill purlin 66 to the rafters 56, two ball locks 132 are inserted into the threaded holes 280*a*, 280*b*. The sill connector block 274 is inserted into the rectangular tubular portion 262 of the sill purlin 66. Two hex head set screws are loosely threaded into threaded holes 282*a*, 282*b* in the rectangular tubular portion 262 of the sill purlin 66, and into threaded holes 280*a*, 280*b* in the side 278 of the sill connector block 274. The ball locks 132 are rotated to align the round blind hole 168 with the holes 276*a*, 276*b* in the sill connector block 274. The assembly of a sill connector block 274 and a sill purlin 66 is placed over two ball lock pins 130 that are threaded into threaded holes 140 in the rafters 56. The ball locks 132 are rotated with a hex wrench that fits through the hex head set screws 134 to bring the assembly of the sill connector block 274 and the sill purlin 66 into tight engagement with the rafter 56. The two hex head set screws 134 are torqued to bring them into tight frictional engagement with the ball locks 132 to lock the sill purlin 66 in place. The assembled sill connector block 274 and sill purlin 66 can be removed from the rafter 56 by loosening the hex head screws 134 and rotating the ball locks 132.

Figure 2:
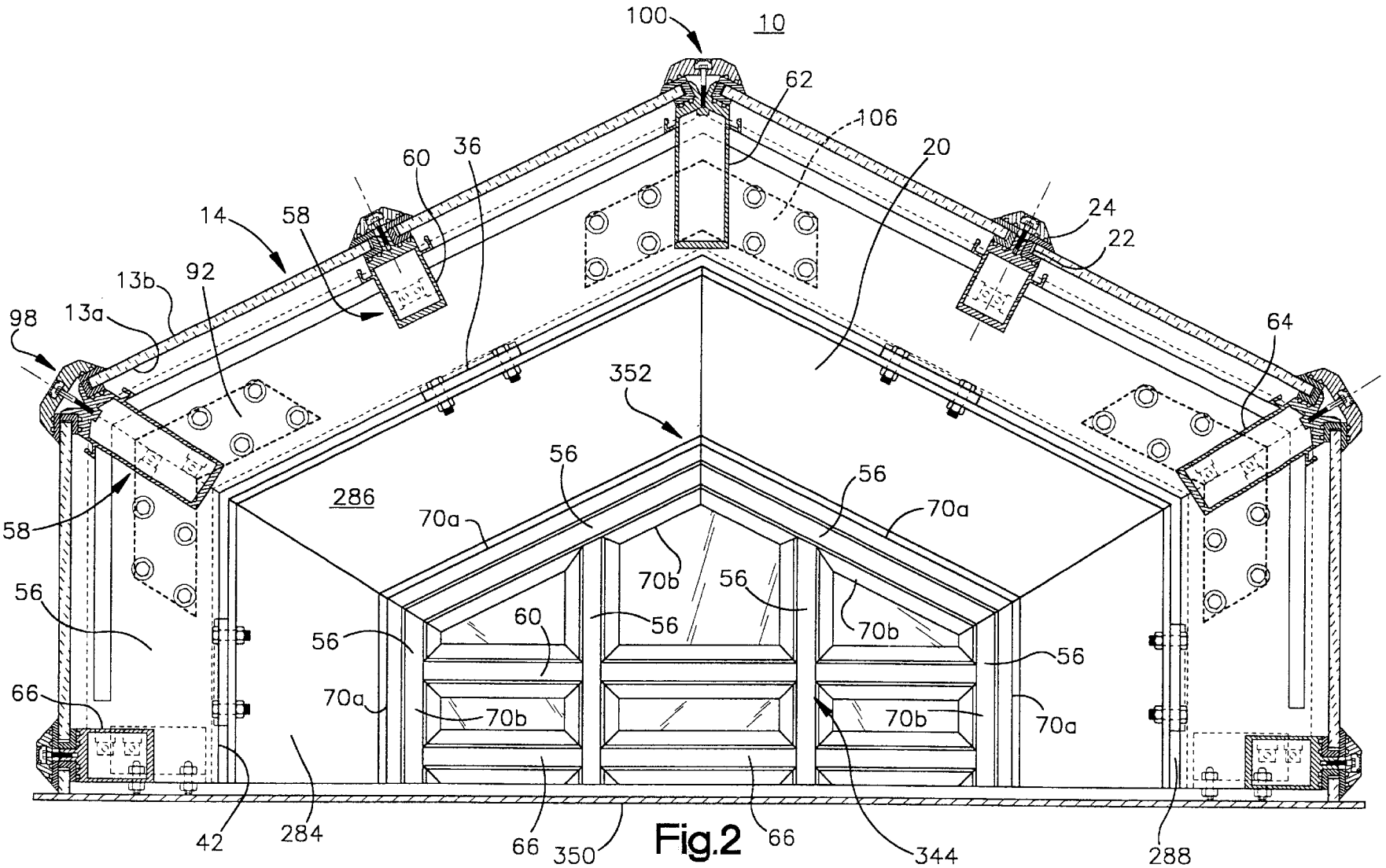
FIG. 2 is a front elevational view of the containment framing system constructed in accordance with the present invention.

Referring to FIGS. 1 and 2, the rafters 56 are connected to a superstructure 284 by their bases 42. The superstructure 284 provides a foundation for the rafters 56 to be connected to. The superstructure 284 will generally be constructed of I-beams 286 shown in FIG. 13), for example, 12 inch I-beams 286 or 10 inch I-beams 286 may be used. A fluid tight connection between the I-beams 284 and the rafters 56 is needed to prevent air from leaking through the junction 288 of the rafters 56 to the I-beams 286. The shape of the assembled rafters 56 will directly correspond with the shape of the superstructure 284.

Figure 13:
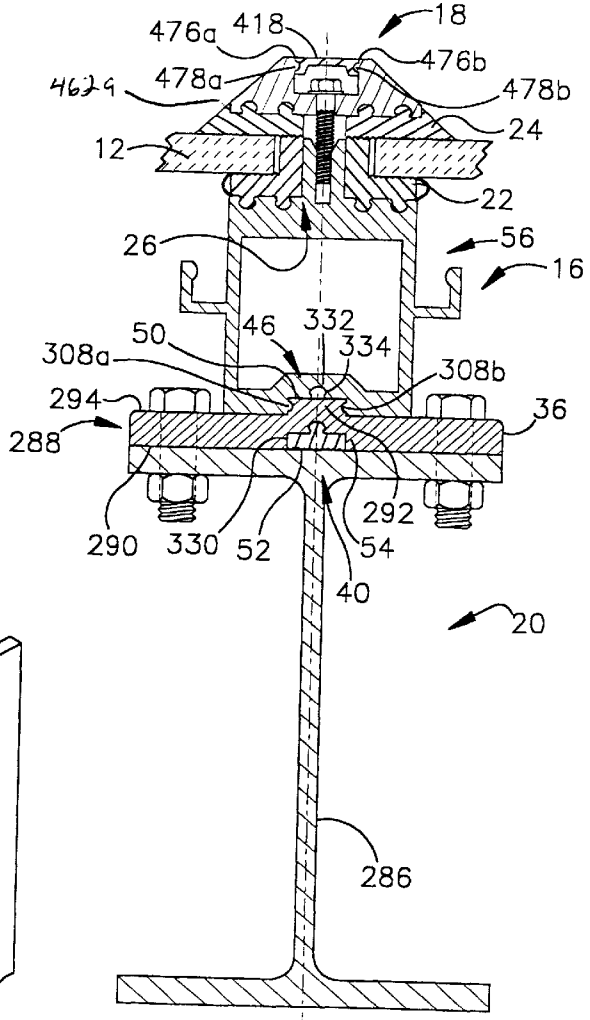
FIG. 13 is a cross-sectional view of the assembly of a rafter, a rafter connector plate, a bottom rafter gasket, and a connector plate gasket.
Figure 12:
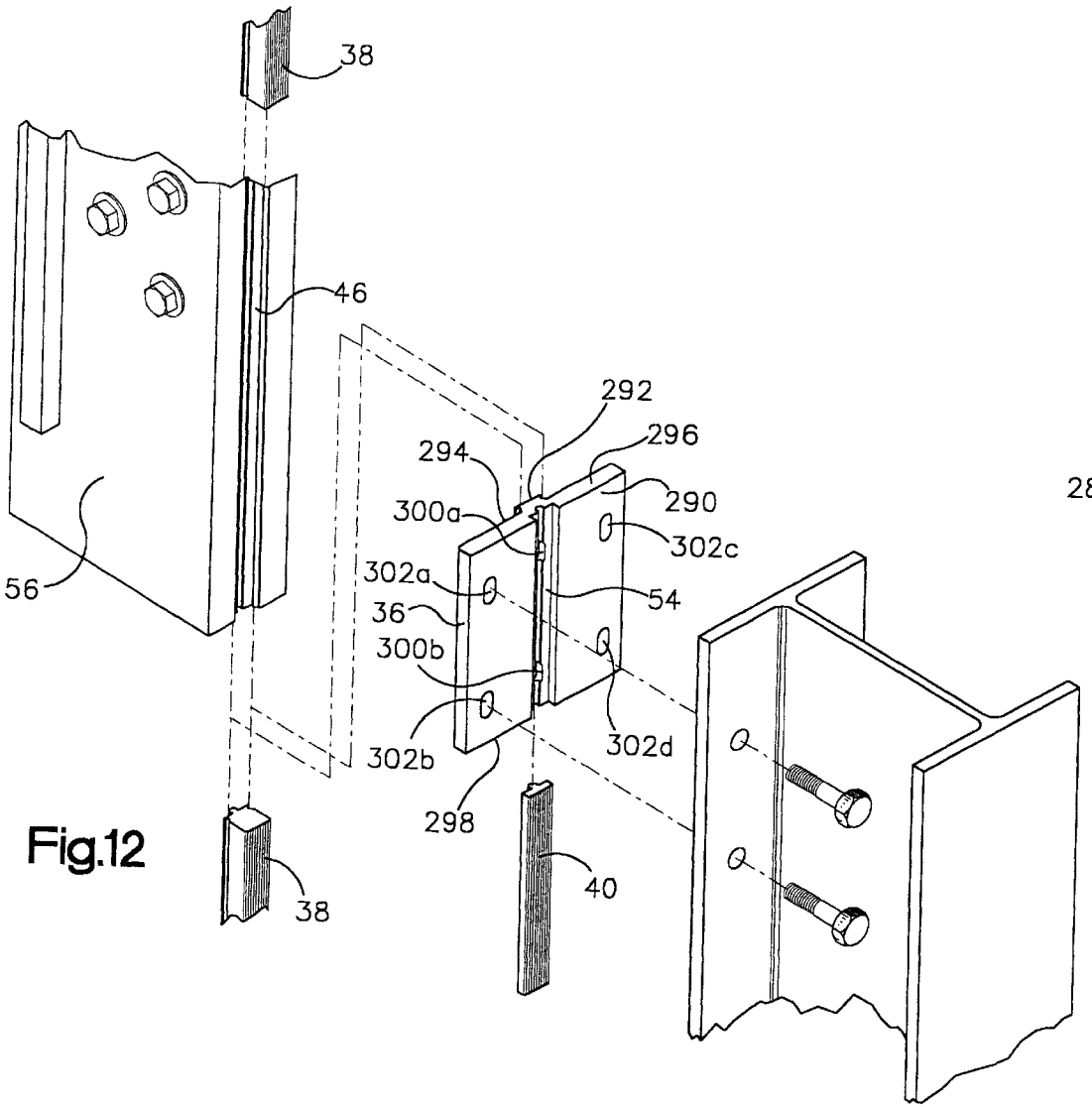
FIG. 12 is an exploded perspective view of the assembly of a rafter, a rafter connector plate, a bottom rafter gasket, and a connector plate gasket.
Figure 14A:
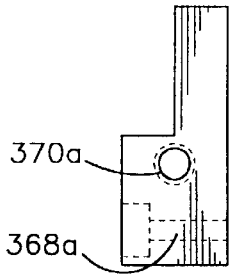
FIG. 14A is a side view of a bottom connector block.
Figure 14B:
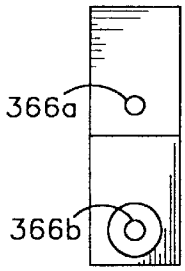
FIG. 14B is a bottom view of a bottom connector block.
Figure 14C:
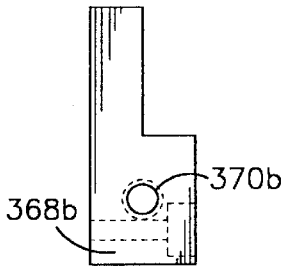
FIG. 14C is a side view of a bottom connector block.
Figure 15:
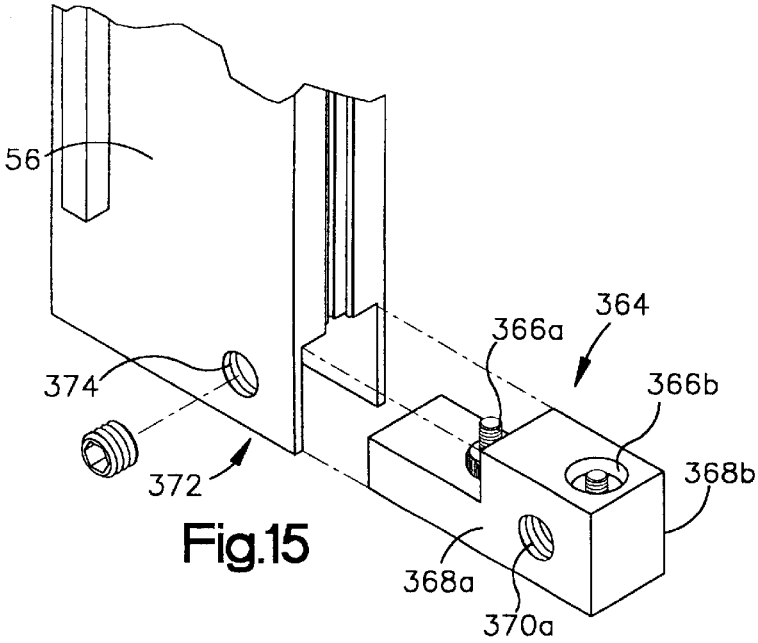
FIG. 15 is a perspective view of an assembly of a bottom connector block to the bottom of a rafter.

Referring to FIGS. 12 and 13, each rafter 56 is connected to the superstructure 284 with one or more rafter connector plates 36, structural carrier gaskets 38 and connector plate gaskets 40 to form a fluid tight seal between each rafter 56 and the superstructure 284. The connector plates 36 are flat metal plates, each having a channel 54 in a first side 290 and a ridge 292 extending from a second side 294. The ridge 292 and channel 54 are centered on the connector plate 36 and extend from the top 296 of the connector plate 36 to the bottom 298 of the connector plate 36. In the exemplary embodiment, the channel 54 in the connector plate 36 includes a wide, shallow cut-out 330 and small semi-circular cut-out 332 (best shown in FIG. 9A). The small semi-circular cut-out 332 is connected to the wide, shallow cut-out 330 by a passage 334. The connector plate 36 includes two rafter mounting slots 300*a*, 300*b*, which pass through the ridge 92 and channel 54 of the connector plate 36, for fastening the connector plate 36 to the rafter 56. The connector plate 36 also includes four I-beam mounting slots 302*a*, 302*b*, 302*c*, 302*d*. Two I-beam slots are on each side of the channel 54 and ridge 292 for mounting the connector plate 36 to the I-beams 286. The ridge 292 of a connector plate 36 fits within a channel 46 in the base 42 of the rafter 56 that allows the connector plate 36 to be slid along the length of the rafter 56.

Referring to FIG. 9A, the rafter gaskets 38 are adapted to be inserted in the rafter channel 46 in the base 42 of a rafter 56. The rafter channel 46 is designed to tightly engage a rafter gasket 38. The rafter channel 46 includes a wide, shallow, cut-out 304 and a deeper small semi-circular cut-out 306. Two nubs 308*a*, 308*b* extend inward from sides 310*a*, 310*b* of the wide shallow cut-out 304. The cross-section of each nub 308*a*, 308*b* generally the shape of a semi-circle. When the rafter gaskets 38 are inserted into the rafter channel 46, the nubs 308*a*, 308*b* tightly engage the rafter gaskets 38. The small, semi-circular cut-out 306 is connected to the wide, shallow cut-out 304 by a narrow passage 312. The small semi-circular cut-out 306 engages a projection 314 that extends from the first side 44 of the structural carrier gasket.

The first side 44 of each rafter gasket 38 is shaped to tightly fit in the rafter channel 46. On the sides 316*a*, 316*b* of each rafter gasket 38 are two semi-circular depressions 318*a*, 318*b*. The semi-circular depressions 318*a*, 318*b* correspond to the two nubs 308*a*, 308*b* of the rafter channel 46. The projection 314 that extends from the first side 44 of the rafter gasket 38 includes a shaft portion 320 that extends upward from the first side 44 of the rafter gasket 38. The shaft portion 320 of the rafter gasket 38 is sized to fit within the passage 312 in the rafter channel 46. Extending upward from the shaft portion 320 of the projection 314 is a semi-circular head 322, which is sized to fit within the semi-circular cut-out 306 of the rafter channel 46 to lock the rafter gasket 38 in the after channel 46.

The second side 48 of the rafter gaskets 38 include a plurality of triangular teeth 324 extending from the second side 48 of the rafter gasket 38. The triangular teeth 324 are designed to make contact with the superstructure 284 at multiple locations to provide multiple seals along the interface between the I-beams 286 and the rafters 56. The rafter gaskets 38 are made of EPDM rubber. One supplier capable of extruding the rafter gaskets 38 is DJ Profiles in England.

Referring to FIGS. 9 and 13, a connector plate gasket 40 is similar to a rafter gasket 38, except the connector plate gaskets 40 are shorter and do not include depressions in their sides 326*a*, 326*b*. In the exemplary embodiment, the first side 50 of the connector plate gasket 40 includes projection 328 that extends from the first side 50. The projection 328 of a connector plate gasket 40 includes a shaft portion 336 and a semi-circular head portion 338. When assembled to a connector plate, the projection 328 extends into the semi-circular cut-out 332 of the connector plate 36 to lock the connector plate gasket 40 in the connector plate channel 54. In an alternative embodiment, the connector plate gasket 40 does not include a projection and the connector plate does not include a small semi-circular cutout 332 for locking the connector plate gasket 40 to the connector plate 36.

The second side 52 of the connector plate gasket 40 also includes a plurality of triangular teeth 340. The triangular teeth 340 on the connector plate gasket 40 also act to provide multiple points of contact between the connector plate gasket 40 and an I-beam 286 of the superstructure 284.

Referring to FIG. 12, a rafter connector plate ridge 292 is inserted into the rafter channel 46 and is moved to a position where the rafter 56 will be secured to the superstructure 284. In the exemplary embodiment, a wet gasket material is applied in the channel 46 in the rafter 56 to provide a seal between the rafter 56 and the connector plate 36. An example of a suitable wet gasketing material is Spectrum II material, which is manufactured by Tremco. Referring to FIG. 13, sheet metal screws 342 are passed through the two rafter mounting slots 300*a*, 300*b* and are driven into two holes (not shown) in the rafter channels 46 to fasten a connector plate 36 to a rafter 56.

Connector plate gaskets 40 having the same length as the connector plates 36 are inserted into connector plate channels 54. If the connector plate gaskets include a projection 328, the shaft portion 336 of each connector plate gasket projection 328 is pushed through the connector plate passage 334, such that the semi-circular head 338 of each connector plate gasket 40 is disposed in the semi-circular cut-out 332 of the connector plate channel 54 to lock the connector plate gasket 40 in the connector plate channel 54. The triangular teeth 340 of the connector plate gasket 40 extend below the first side 290 of the connector plate 36.

The remainder of the length of the rafters 56 which engage external I-beams 286 are filled with rafter gaskets 38. The rafter gaskets 38 are cut to length and are pushed into the rafter channels 46 of the rafters 56, such that the rafter gaskets 38 are in abutment with the connector plates 36 and connector plate gaskets 40. When each rafter gasket 38 is inserted into the rafter channels 46, the shaft portion 320 of the rafter gasket 38 is forced through the passage 312 of the rafter channel 46 and the semi-circular head 322 of the rafter gasket 38 becomes disposed within the semi-circular cut-out 306 of the rafter channel 46 to lock the rafter gasket 38 in place. Also securing the rafter gasket in place are the nubs 308*a*, 308*b* in the rafter channel 46. When the rafter gasket 38 is pushed into the rafter channel 46, the semi-circular depressions 318*a*, 318*b* surround the nubs 308*a*, 308*b* in the rafter channel 46 to lock the rafter gasket 38 in place. With the rafter gasket 38 installed, the triangular teeth 324 of the rafter gasket 38 extend below the first side,290 of the connector plate 36, and are substantially in abutting alignment with the plurality of triangular teeth 340 of the connector plate gasket 40.

Referring to FIGS. 12 and 13, once the connector plates 36, connector plate gaskets 40 and rafter gaskets 38 are secured to the rafter 56, the rafters 56 may be secured to the superstructure 284 by the connector plates 36. The I-beam mounting slots 302*a*, 302*b*, 302*c*, 302*d* are lined-up with corresponding openings (not shown) in the I-beams 286. The rafter connector plates 36 are then connected to the I-beams 286 using conventional fasteners, For example, 1¼ inch by ⅜ inch hex head machine bolts may be used to fasten the connector plates 36 to the I-beams 286. When the rafter connector plates 36 are tightened down to the I-beams 286, the triangular teeth 324 and 340 of the rafter gasket 38 and connector plate gasket 40 contact the I-beams 286 at multiple locations and form a seal between the rafters 56 and the I-beams 286. The compression of the rafter gaskets 38 and connector plate gaskets 40 causes seals to be formed between the rafter gaskets 38 and the rafters 56 and between the connector plate gaskets 40 and the connector plates 36 along an entire length, where the rafters 56 are joined to the I-beams 286.

Referring to FIGS. 1 and 2, the front gable end 344 and rear gable end 346 of the frame 14 are framed using rafters 56, intermediate purlins 60 and sill purlins 66. Connection sides 70*a* of the rafters 56 are attached to an attachment surface 348 defined by the I-beams 286.

The second side 70*b* of the rafters 56 that are connected to the I-beams 286 include a large clearance hole (not shown). The first side 70*a* of the rafters 56 that are connected to the I-beams 286 at the front gable end 344 include a smaller hole (not shown). A mechanical fastener is inserted completely through the large hole in the second side 70*b* of the rectangular portion 68 of the rafter 56. The mechanical fastener is then fed through the smaller hole in the first side 70*a* of the rafter 56 and into a corresponding hole in the I-beam 286. The head of the fastener abuts against the first side 70*a* of the rafter 56. The fastener is torqued down to bring the first side 70*a* of the rafter 56 into tight engagement with the superstructure 284, In the exemplary embodiment, the fastener is a cap screw which seals the holes (not shown) in the rafters 56 and the I-beams 286. These steps are repeated until rafters 56 have been attached to all of the I-beams 286 that form the front gable end.

The rear gable end 346 may or may not include framing for translucent panels 12. When the rear gable end 346 is not freed, the rear gable end 346 is attached to an adjacent building or structure.

Sill purlins 66 are connected to the bottom 350 of the frame 14 by mechanical fasteners. The vertical members of the gable ends 344 and 346 are rafters 56. The rafters 56 are attached to the bottom 350 of the frame 14 and to the rafters 56 at the top 352 of the gable end 344. The top ends 354 of the rafters 56 used on the gable 344 are mitered to match the angle of the top 352 of the gable 344.

Figure 16A:
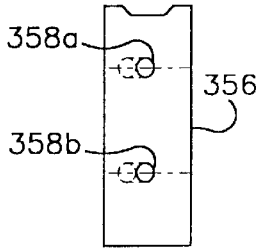
FIG. 16A is a top view of a top connector block.
Figure 16B:
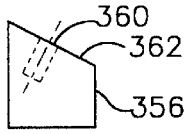
FIG. 16B is a side view of a top connector block.
Figure 17:
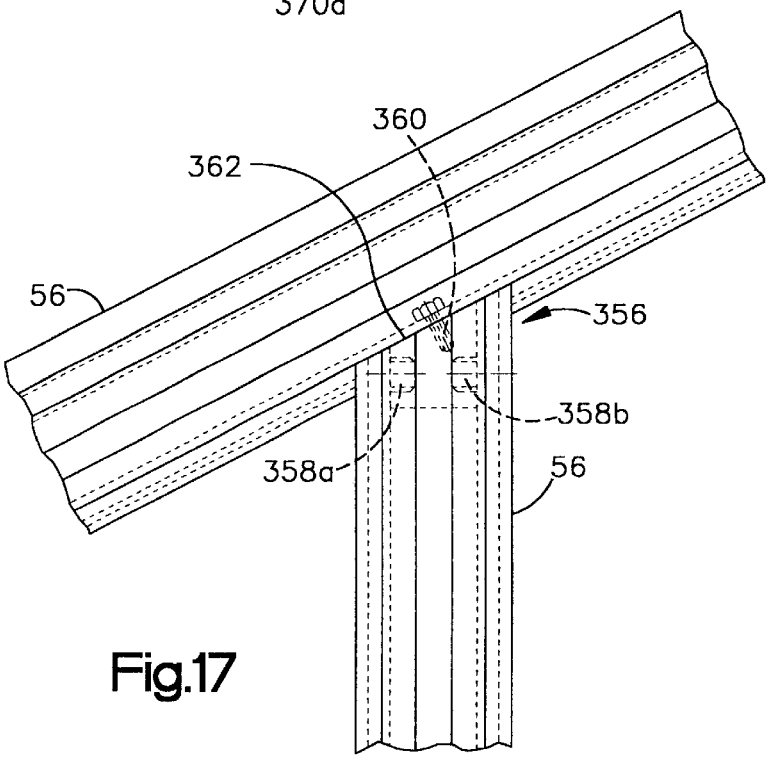
FIG. 17 is a partial front elevational view of two rafters of a gable end assembled together with a top connector block.

Referring to FIGS. 16A, 16B and 17, a top connector block 356 is used to connect each vertically extending rafter to the rafters 56 that form the top 352 of the gable 344. The top connector block 356 is cut an angle corresponding to the top 352 of the gable 344. The top connector block 356 includes two threaded holes 358*a*, 358*b* for mounting the top connector block 356 to the rafters 56 that extend vertically. The top connector block also includes a threaded hole 360 in an inclined face 362 for connecting the top connector block 356 to the rafter 56 that forms the top 352 of the gable.

The bottom of the rafters 56 which extend vertically on the front gable 344 are fastened to the bottom 350 of the frame 14 using bottom connector blocks 364, as shown in FIGS. 14A, 14B, 14C and 15. Each bottom connector block 364 is a stepped block having two clearance holes 366*a*, 366*b* that accommodate attachment of a bottom connector block 364 to the bottom of the frame 350. The sides 368*a*, 368*b* include threaded holes 370*a*, 370*b* that facilitate attachment to rafters 56 that extend vertically. The rafters 56 that extend vertically have a notched-out base 372 and threaded holes 374. The rafters 56 that extend vertically are placed over the bottom connector blocks 364 and are fastened to the bottom connector blocks 364 with threaded fasteners.

At this point, the gable end 344 has sill purlins extending across the base of the frame 14, rafters 56 connected to the I-beams 286 and rafters 56 that extend vertically from the base 350 of the frame 14 to the top 352 of the gable 352.

Referring to FIGS. 1 and 2, the grid 376 on the gable end 344 is completed by assembling intermediate purlins 60 to the rafters 56 in a horizontal orientation. The intermediate purlin 60 are connected to the rafters 56 of the gable end 344 in the same manner that the intermediate purlins 60 are attached to the rafters 56 in constructing the frame 14. Intermediate purlin connector blocks 212 are used to mount intermediate purlins 60 to rafters 56 to complete the framing of the gable ends.

Once the rafters 56 and purlins 58 have been assembled together to form the frame 14, the L-shaped gaskets 22 can be applied about the perimeter of the glazing profiles of the rafters 56, the intermediate purlins 60, the ridge purlins 62, the knee purlins 64 and the sill purlins 66.

Referring to FIGS. 9A–9E, as the name suggests, the L-shaped gaskets 22 are in the general shape of an "L". The bottom surface 378 and side surface 380 are the structural carrier member engaging surfaces 26. The lower portion 382 includes a plurality of triangular teeth 384 extending from the lower portion's top surface 386. The top surface 34 of the upright portion 388 also includes a plurality of triangular teeth 390. Each L-shaped gasket 22 includes two projections 86*a*, 86*b* that extend from the bottom surface 378. The projections 86*a*, 86*b* include shaft portions 392 (FIG. 9E) and semi-circular head portions 394 that are the same or similar to the shaft portion 320 and semi-circular head portion 322 of the rafter gasket. The projections 86*a*, 86*b* are inserted into channels 84*a*, 84*b* in the rafters 56 and purlins 58. When the projections 86*a*, 86*b* of each L-shaped gasket 22 are inserted into the channels 84*a*, 84*b*, the shaft portion 392 of the L-shaped gasket 22 is forced through the passages 87 of the channels 84*a*, 84*b* and the semi-circular head 394 of the L-shaped gasket 22 becomes disposed within the semi-circular cut-out 89 of the channels 84*a*, 84*b* to lock each L-shaped gasket 38 in place.

Figure 10:
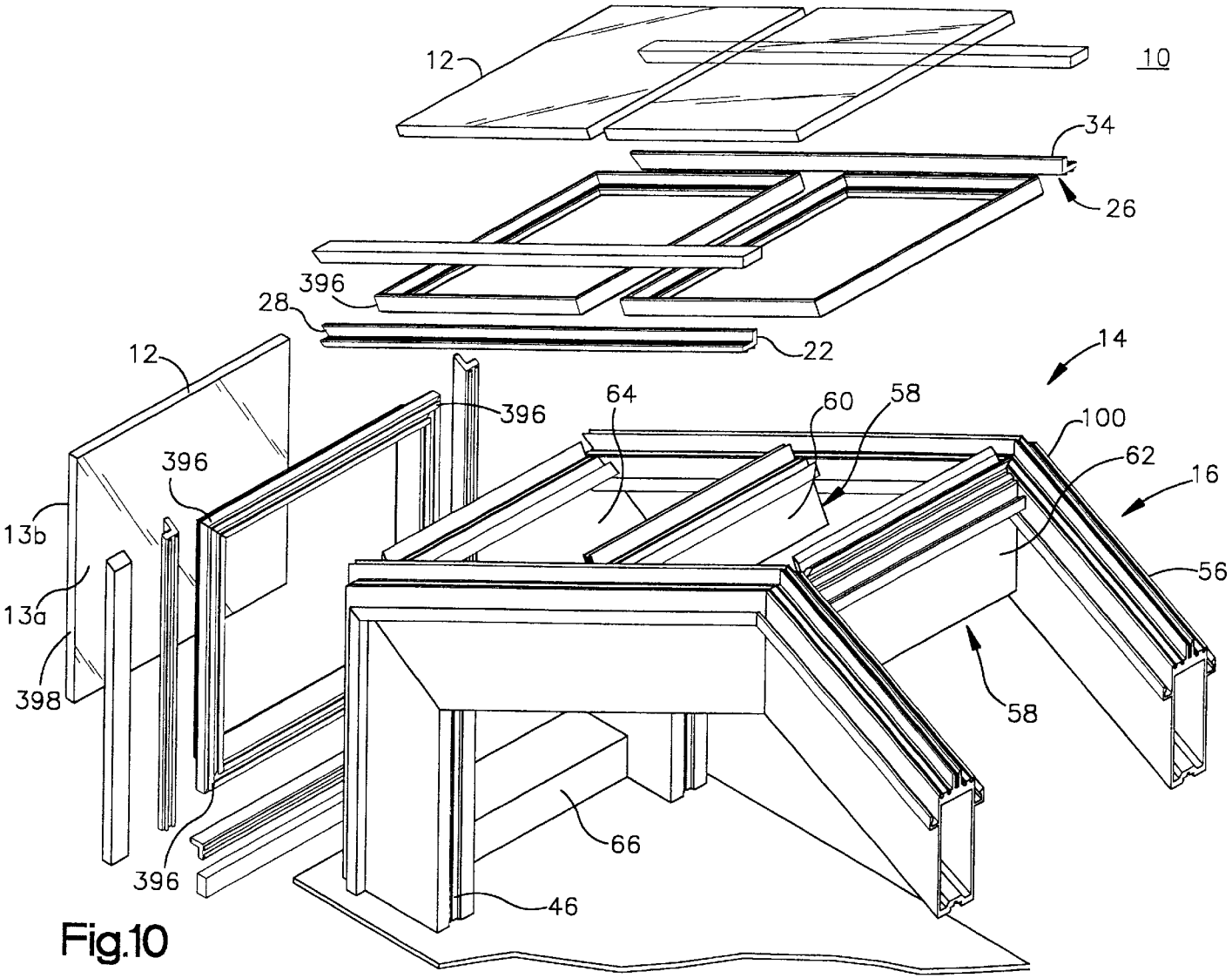
FIG. 10 is an exploded perspective view of a framing system, lower L-gasketing and translucent panels.

Referring to FIG. 10, L-shaped gaskets are inserted into each of the glazing profiles of the rafters 56 and purlins 58 that make up the frame 14. At each location where the rafters 56 meet the purlins 58 or, as on the gable end 344, the rafters 56 intersect other rafters 56, the ends 396 of the L-shaped gaskets 22 are mitered at 45° angles and connected together, so that they will form a continuous seal around the perimeter 398 of each translucent panel 12. The ends 396 are fused together by gluing, welding, sonically welding or melting them together. In the exemplary embodiment, the L-shaped gaskets 22 that correspond with each translucent panel 12 are first connected together and then inserted into the channels 84*a*, 84*b* of the rafters 56 and purlins 58. When all of the L-shaped gaskets 22 have been applied to the rafters 56 and purlins 58, the translucent panels 12 are placed on the L-shaped gaskets 22 and secured with pressure plates 18 assembled to upper gaskets 24.

Referring to FIGS. 9A–9D, the pressure plates 18 vary depending on the slope of the glazing profile. Planar pressure plate 400 can be used with the rafters 56, the intermediate purlins 60 and the sill purlins 66, since the only difference in the glazing profiles 74, 204, 264 is the slope. Each planar pressure plate 400 includes a planar surface 402 having four channels 404*a*, 404*b*, 404*c*, 404*d* that facilitate mounting of the upper gaskets 24. The channels 404*a*, 404*b*, 404*c*, 404*d* include a passage 406 that extends into a semi-circular cut-out 408. Two sides 410*a*, 410*b* are inclined and extend upward to the top 412 of the planar pressure plate 400. The top 412 includes a channel 414 that allows connectors used to mount the planar pressure plate 400 to be concealed below the top 412 of the planar pressure plate 400. The channel 414 and the top 412 of the planar pressure plate 400 includes two nubs 416*a*, 416*b* for holding a cap 418 in place.

Referring to FIG. 9C, each ridge pressure plate 420 includes a planar surface 422 that extends outward to two inclined gasket accommodating surfaces 424*a*, 424*b*. The inclined gasket accommodating surfaces 424*a*, 424*b* correspond to the slope 116 of the ridge purlin 62. Each ridge pressure plate 420 includes four channels 426*a*, 426*b*, 426*c*, 426*d*, two in each inclined gasket accommodating surface 424*a*, 424*b*. The ridge pressure plate channels 426*a*, 426*b*, 426*c*, 426*d* each include a passage 428 that extends into a semi-circular cut-out 430. The sides 432*a*, 432*b* of the ridge pressure plate 420 are comprised of two abutting planar segments that extend upward to a top 434 of the ridge pressure plate 420. The top 434 of the ridge pressure plate 420 includes a screw concealing channel 436 that extends into the center of the ridge pressure plate 420. The screw concealing channel 436 of the ridge pressure plate 420 is the same as the screw concealing channel 436 of the planar pressure plate 400, including two nubs 438*a*, 438*b* for capturing a cap 418.

Referring to FIG. 9D, the knee pressure plates 440 are generally the same as the ridge pressure plates 420, except that the gasket accommodating surfaces 442*a*, 442*b* are at different angles. The knee pressure plate 440 includes a planar surface 444 with two inclined gasket accommodating surfaces 442*a*, 442*b* extending from it. The gasket accommodating surfaces 442*a*, 442*b* of the knee pressure plate 440 include four channels 446*a*, 446*b*, 446*c*, 446*d* for connection of upper gaskets 24. The channels 446*a*, 446*b*, 446*c*, 446*d* each include a passage 448 that extends into a semi-circular cut-out 450. The sides 452*a*, 452*b* of the knee pressure plate 440 are comprised of two abutting planar segments that extend upward to the top 454 of the knee pressure plate. In the center of the knee pressure plate 440, extending in from the top 454 is a channel 456 for concealing connectors used to mount the knee pressure plate 440. The channel 456 of the knee pressure plate 440 is identical to the channels of the planar pressure plate 400 and the ridge pressure plate 420. The channel 456 includes two nubs 458*a*, 458*b* for securing a cap 418 to the knee pressure plate.

Figure 9F:
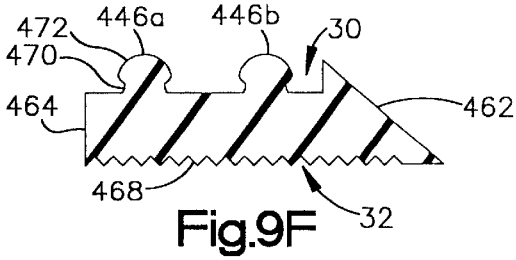
FIG. 9F is an enlarged cross-sectional view of an upper gasket.

Referring to FIG. 9F, like the L-shaped gaskets 22, the same upper gaskets 24 are used for each pressure plate 18. The upper gaskets 24 each include a glass sealing surface 32, a pressure bar engaging surface 30, a vertical side 464, an inclined side 462 and two projections 466*a*, 466*b* that extend from the pressure bar engaging surface 30. The glass sealing surface 32 includes a plurality of triangular projections 468 that extend down from the glass sealing surface 32. The projections 466*a*, 466*b* that extend from the pressure bar engaging surface 30 each include a shaft 470 and a semi-circular head 472. The upper gasket 24 is wider than the L-shaped gasket, so that when installed, the upper gasket 24 will overlap a greater extent of the translucent panel 12 than the L-shaped gasket 22. Triangular projections 468 extend the entire width of the upper gasket 24. The incline side 462 of the upper gasket 24 extends slightly above the pressure bar engaging surface 30.

Figure 11:
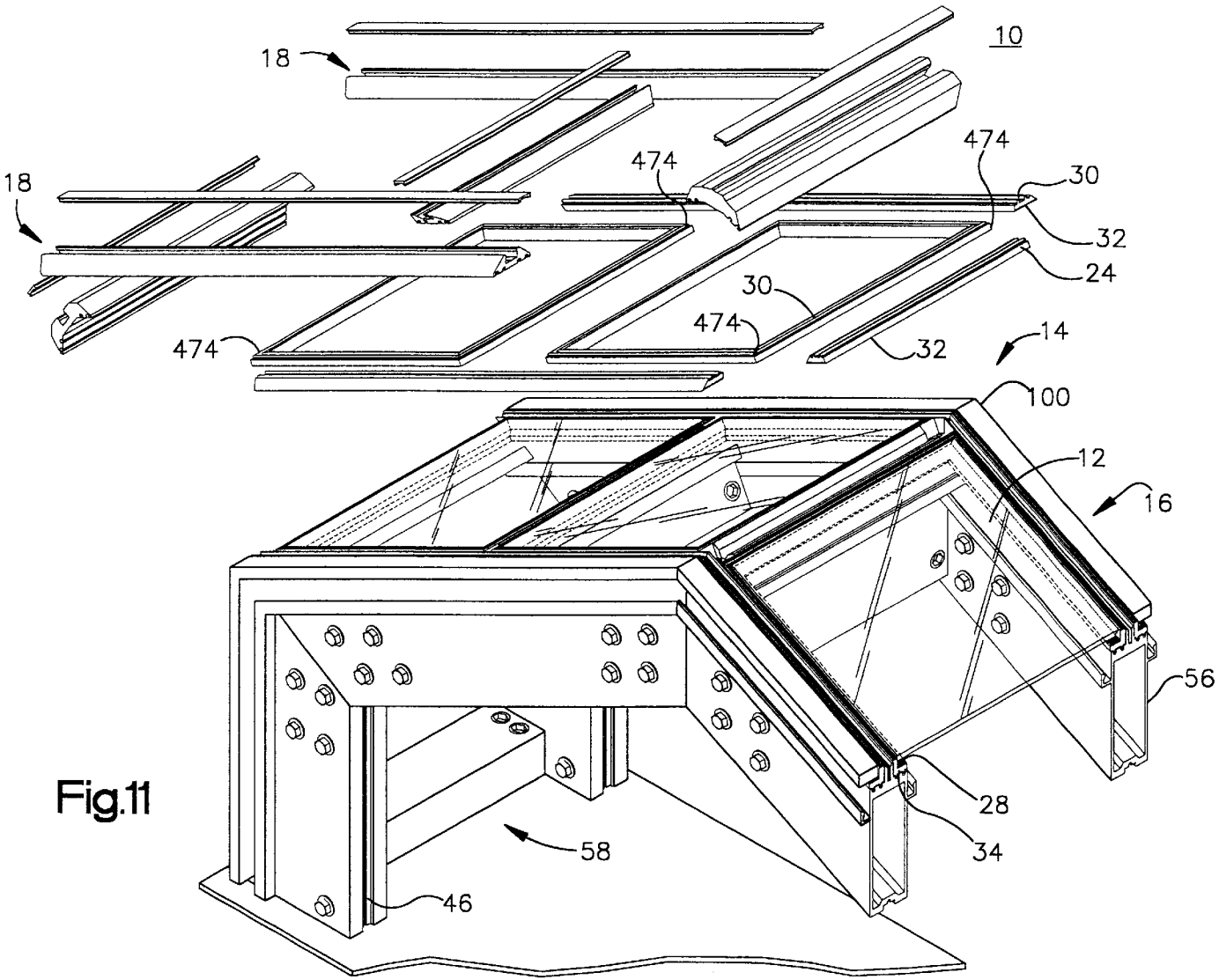
FIG. 11 is an exploded perspective view of the containment framing and gasketing system of the present invention.

Referring to FIG. 11, the upper gaskets 24 are attached to the planar pressure plates 400, ridge pressure plates 420 and knee pressure plates 440 by orienting the vertical side 464 of the upper gasket 24 toward the center of the pressure plates 18. The projections 466*a*, 466*b* of the top gasket 24 are aligned with corresponding channels 404*a*–404*d*, 426*a*–426*d*, 446*a*–446*d* and are pressed into the channels. The semi-circular head 472 of the top gasket 24 becomes disposed in the semi-circular cut-outs 408, 430, 450 to lock the upper gaskets 24 in place. The shaft 470 of the top gasket 24 extends through the passage 406, 428, 448 of the channels. When installed a lip 462*a* of the inclined side 462 of the top gasket 24 extends past the sides of the pressure plates 18. The pressure bar engaging surface 30 engages the pressure bar 18.

Referring now to FIGS. 9A, 9B, 9C, 9D and 13, the assembled upper gaskets 24 and pressure bars 18 are assembled to the translucent panels 12 that are resting on the assembly of L-shaped gaskets 24 and structural carrier members 16. The planar pressure plates 400, ridge pressure plates 420 and knee pressure plates 440 are placed on corresponding rafters 56, intermediate purlins 60, sill purlins 66, ridge purlins 62 and knee purlins 64. The center of each pressure plate 18 is aligned with each screw boss of the rafters 56 and the purlins 58.

Referring to FIG. 11, at each location where a pressure plate 18 intersects another pressure plate, the ends 474 of the upper gaskets 24 are mitered at 45° angles and connected together, so that they will form a continuous seal around the perimeter 398 of each translucent panel 12. The ends 474 are fused together by gluing, welding, sonically welding or melting them together.

Mechanical fasteners are inserted through holes (not shown) in the pressure bars 18 to connect the pressure bars 18 to the rafters 56 and purlins 58. In the exemplary embodiment, the fasteners used are number 12 sheet metal screws that are torqued to approximately 85 foot pounds. When properly torqued, the triangular teeth 384 of the L-shaped gasket sealing surface 28 are deformed by the first side 13*a* of the translucent panel 12 at a plurality of locations to form seals between the L-shaped gasket and the translucent panel 12. The triangular projections 468 that extend from the glass sealing surface 32 of the upper gasket 24 engage the second side 13*b* of the translucent panels 12 to provide a plurality of seals between the upper gasket 24 and the second side 13*b* of the translucent panel 12. When properly torqued, the triangular teeth 390 of the upright portion 388 of the L-shaped gasket 22 engage the triangular projections 468 of the upper gasket to provide a seal between the upper gasket 24 and the L-shaped gasket 22.

When the pressure plates 18 are properly assembled to the rafters 56 and purlins 58, the bottom surface 378 of the L-shaped gasket 22 tightly engages the rafters 56 and purlins 58 to form a fluid tight seal and the pressure bar engaging surface 30 of the upper gasket 24 tightly engages the pressure plates 18 to form a fluid tight seal between the upper gasket 24 and the pressure plates 18. When the containment structure is properly assembled, the-lower portion 382 of the L-shaped gasket 22 is compressed and a small bulge or bubble (not shown) will extend from the side of the rafter 56 or purlin 58.

Referring to FIG. 13 the cap 418 is a flat extruded strip of plastic, Each cap 418 corresponds to a pressure plate 18. The purpose of the caps 418 is to conceal the hardware used to assemble the frame 14. Each cap 418 includes two sides 476*a*, 476*b* having recesses 478*a*, 478*b*. Each cap 418 is installed on a corresponding pressure plate 18 by snapping the sides 476*a*, 476*b* into the channel of the pressure bar, causing the recesses 478*a*, 478*b* of the cap 418 to engage the nubs in the pressure plate channel.

When assembled properly, air is impeded from entering the seals formed by the pressure plates 18, upper gaskets 24, L-shaped gaskets 22 and rafters 56 or purlins 58. In order to penetrate the seal of the containment structure 10, air or moisture must penetrate the seals between the first translucent panel side 13*a* and the sealing surface 28 of the L-shaped gasket 22 and the seal between the second side 13*b* of the translucent panel and the glass sealing surface 32 of the upper gasket 24 or air would have to penetrate the seals between the pressure bar engaging surface 18 of the upper gasket 24 and the pressure plates 18 and penetrate the seal between the glazing profile 74 and the L-shaped gasket 22.

The containment framing structure 10 of the present invention was designed to quarantine and study plants. The containment framing structure 10 meets BSL level 3 requirements. BSL level 3 requirements ensure that plants and other organisms are not allowed to escape the containment framing structure 10 and possibly reproduce outside the structure 10, causing harm to the environment.

The containment framing structure 10 allows not more than 0.03 cubic feet per minute of air pressurized at 6.24 pounds per square foot (above atmospheric pressure) to enter the structure 10. The containment framing structure does not allow any water pressurized at 10 pounds per square foot (above atmospheric) to enter the structure 10.

The containment structure 10 does not include any weep holes that allow moisture to escape. Any moisture that is trapped in the greenhouse 10 is forced downward by gravity on the translucent panels 12 to the gaskets 22, 24, where the moisture drips into to the drip gutters in the purlins 58. The ends 59 of the purlin drip gutters are notched back slightly (not shown), allowing moisture in the purlin drip gutters to be channeled downward by the drip gutters 74 of the rafters 56.

The rafters 56 and purlins 58 can be used to form structures other than specifically identified in the specification and shown in the drawings. For example, the containment structure 10 of the present invention can be used to make skylights or corridors in a containment framing system. Although the system is shown in use with a superstructure 284 formed of I-beams 286, it should be readily apparent that the unique design of the rafters 56 and purlins 58 allow it to be used to form structures without the necessity of a superstructure 284. The rafters 56 and purlins 58 used in the present invention are very strong and allow very long spans to be traversed.

Although the present invention has been described with a degree of particularity, it is the intent that the invention include all modifications and alterations falling within the spirit or scope of the appended claims.

I claim:

1. A containment structure for providing a fluid tight seal between a translucent panel having first and second sides and a frame having a structural carrier member and a pressure bar, comprising:

a) an L-shaped gasket including a structural carrier member engaging surface for connecting said L-shaped gasket to said structural carrier member, a first glass sealing surface for providing a seal between said L-shaped gasket and said first side of said translucent panel, and a first gasket sealing surface; and b) an upper gasket including a pressure bar engaging surface for connecting said upper gasket to said pressure bar, a second glass sealing surface for providing a seal between said upper gasket and said second side of said translucent panel, and a second gasket sealing surface for contacting said first gasket sealing surface of said L-shaped gasket to form a seal between said L-shaped gasket and said upper gasket.

2. The apparatus of claim 1 further comprising at least one projection extending from said structural carrier member engaging surface for insertion into a corresponding at least one channel in said structural carrier member.

3. The apparatus of claim 1 further comprising at least one projection extending from said pressure bar engaging surface for insertion into a corresponding at least one channel in said pressure bar.

4. The apparatus of claim 1 wherein said structural carrier member engaging surface is adapted to provide a seal between said L-shaped gasket and said structural carrier member.

5. The apparatus of claim 1 further wherein said pressure bar engaging surface is adapted to provide a seal between said upper gasket and said pressure bar.

6. The apparatus of claim 1 wherein said second glass sealing surface and said second gasket sealing surface of said upper gasket are a continuous surface.

7. The apparatus of claim 1 wherein said first glass sealing surface of said L-shaped gasket includes a plurality of deformable teeth for contacting a plurality of locations on said first side of said translucent panel.

8. The apparatus of claim 1 wherein said second glass sealing surface of said upper gasket includes a plurality of teeth for contacting a plurality of locations on said second side of said translucent panel.

9. The apparatus of claim 1 wherein at least two L-shaped gaskets and at least two upper gaskets are bonded together to form a seal around a corner of said translucent panel.

10. A method of providing a fluid tight seal between a translucent panel having first and second sides and a frame having a structural carrier member and a pressure bar, comprising:

a) applying an L-shaped gasket to said structural carrier member;

b) placing said translucent panel on said L-shaped gasket, such that said first side of said translucent panel is in contact with said L-shaped gasket; and c) coupling an upper gasket to said L-shaped gasket and said second side of said translucent panel with said pressure bar to form seals between said L-shaped gasket and said first side of said translucent panel, between said L-shaped gasket and said upper gasket, and between said upper gasket and said second side of said translucent panel.

11. The method of claim 10 wherein said coupling step forms a seal between said L-shaped gasket and said structural carrier member.

12. The method of claim 10 wherein said coupling step forms a seal between said upper gasket and said pressure bar.

13. The method of claim 10 further comprising the step of bonding at least two L-shaped gaskets together and bonding at least two upper gaskets together to form a seal around a corner of said translucent panel.

14. The method of claim 10 wherein said L-shaped gasket includes teeth which are deformed when contacting said first side of said translucent panel at a plurality of locations.

15. The method of claim 10 wherein said upper gasket includes teeth which are deformed when contacting said second side of said translucent panel at a plurality of locations.

16. A method of providing a fluid tight connection between a structural carrier member and an adjoining structural member, comprising:

a) connecting a base of said structural carrier member to a connector plate;

b) inserting a structural carrier gasket into a channel in said base of said structural carrier member;

c) inserting a connector plate gasket into a second channel in said connector plate; and d) fastening said connector plate to said adjoining structural member to bring said structural carrier gasket and said connector plate gasket into contact with said adjoining structural member to form seals between said structural carrier member and said adjoining structural member.

17. The method of claim 16 further comprising the step of abutting said structural carrier gasket with said connector plate.

18. The method of claim 16 further comprising the step of providing a gasketing material in said channel of said structural carrier between said structural carrier member and said connector plate to provide a seal between said structural carrier member and said connector plate.

19. The method of claim 16 wherein said structural carrier gasket includes teeth which are deformed when contacting said adjoining structural member at a plurality of locations.

20. The method of claim 16 wherein said connector plate gasket includes teeth for contacting said adjoining structural member at a plurality of locations.

21. A containment structure for providing a fluid tight connection between a structural carrier member and an adjoining structural member, comprising:

a) a connector plate connected to a base of said structural carrier member;

b) a structural carrier gasket having a first side adapted to fit in a channel in said base of said structural carrier member and a second side for contacting said adjoining structural member to form a fluid tight seal between said structural carrier member and said adjoining structural member when said connector plate is fastened to said adjoining structural member; and c) a connector plate gasket having a first side adapted to fit in a channel in said connector plate and a second side for contacting said adjoining structural member to form a fluid tight seal between said connector plate and said adjoining structural member when said connector plate is fastened to said adjoining structural member.

22. The apparatus of claim 21 further comprising a gasketing material adapted to be applied in said first channel of said structural carrier between said structural carrier member and said connector plate to provide a seal between said structural carrier member and said connector plate.

23. The apparatus of claim 21 wherein said first side of said structural carrier gasket includes teeth for contacting said adjoining structural member at a plurality of locations.

24. The apparatus of claim 21 wherein said first side of said connecting plate gasket includes teeth for contacting said adjoining structural member at a plurality of locations.

25. The apparatus of claim 21 further comprising a projection extending from said first side of said structural carrier gasket for insertion into a corresponding gasket retaining channel in said first channel of said structural carrier member.

26. The apparatus of claim 21 wherein said connector plate includes a ridge adapted to fit in said channel in said base of said structural carrier member.

27. A containment structure for providing fluid tight seals between a translucent panel and a frame, having a structural carrier member and a pressure bar, and between the structural carrier member and an adjoining structural member, comprising:

a) an L-shaped gasket including a structural carrier member engaging surface for connecting said L-shaped gasket to said structural carrier member, a first glass sealing surface for providing a seal between said L-shaped gasket and a first side of said translucent panel, and a first gasket sealing surface;

b) an upper gasket including a pressure bar engaging surface for connecting said upper gasket to said pressure bar, a second glass sealing surface for providing a seal between said upper gasket and a second side of said translucent panel, and a second gasket sealing surface for contacting said first gasket sealing surface of said L-shaped gasket to form a seal between said L-shaped gasket and said upper gasket;

c) a connector plate connected to a base of said structural carrier member;

d) a structural carrier gasket having a first side adapted to fit in a first channel in said base of said structural carrier member and a second side for contacting said adjoining structural member to form a fluid tight seal between said structural carrier member and said adjoining structural member when said connector plate is fastened to said adjoining structural member; and e) a connector plate gasket having a first side adapted to fit in a channel in said connector plate and a second side for contacting said adjoining structural member to form a fluid tight seal between said connector plate and said adjoining structural member when said connector plate is fastened to said adjoining structural member.

28. A method of providing a fluid tight seals between a translucent panel and a frame, having a structural carrier member and a pressure bar, and between the structural carrier member, having a base connected to a connector plate, and an adjoining structural member, comprising;

a) applying an L-shaped gasket to said structural carrier member;

b) placing said translucent panel on said L-shaped gasket, such that a first side of said translucent panel is in contact with said L-shaped gasket; and c) coupling an upper gasket to said L-shaped gasket and a second side of said translucent panel with said pressure bar to form seals between said L-shaped gasket and, said first side of said translucent panel, between said L-shaped gasket and said upper gasket, and between said upper gasket and said second side of said translucent panel;

d) connecting a base of said structural carrier member to a connector plate e) inserting a structural carrier gasket into a channel in said base of said structural carrier member;

f) inserting a connector plate gasket into a channel in said connector plate; and g) fastening said connector plate to said adjoining structural member to bring said structural carrier gasket and said connector plate gasket into contact with said adjoining structural member to form seals between said structural carrier member and said adjoining structural member and between said connector plate and said adjoining structural member.

* * * * *